US007674205B2

(12) United States Patent
Dalebout et al.

(10) Patent No.: US 7,674,205 B2
(45) Date of Patent: Mar. 9, 2010

(54) ELLIPTICAL EXERCISE MACHINE WITH ADJUSTABLE FOOT MOTION

(75) Inventors: William T. Dalebout, North Logan, UT (US); Gaylen W. Ercanbrack, Logan, UT (US); Jaremy T. Butler, Paradise, UT (US); N. Jeffrey Chatterton, Logan, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 11/745,708

(22) Filed: May 8, 2007

(65) Prior Publication Data

US 2008/0280731 A1 Nov. 13, 2008

(51) Int. Cl.
*A63B 22/04* (2006.01)

(52) U.S. Cl. ..... 482/52; 482/908

(58) Field of Classification Search ..... 482/51–53, 482/57, 62, 70, 71, 908; *A63B 22/04*
See application file for complete search history.

(56) References Cited

U.S. PATENT DOCUMENTS

| | | | |
|---|---|---|---|
| 3,316,898 | A | 5/1967 | Brown |
| 3,824,994 | A | 7/1974 | Soderberg, Sr. |
| 3,941,377 | A | 3/1976 | Lie |
| 4,140,312 | A | 2/1979 | Buchmann |
| 4,300,760 | A | 11/1981 | Bobroff |
| 4,340,214 | A | 7/1982 | Schützer |
| 4,354,675 | A | 10/1982 | Barclay |
| 4,679,787 | A | 7/1987 | Guilbault |
| 4,708,338 | A | 11/1987 | Potts |
| 4,720,093 | A | 1/1988 | Del Mar |
| 4,938,474 | A | 7/1990 | Sweeney et al. |
| 5,013,031 | A | 5/1991 | Bull |
| 5,039,088 | A | 8/1991 | Shifferaw |
| 5,078,389 | A | 1/1992 | Chen |
| 5,135,447 | A | 8/1992 | Robards, Jr. et al. |
| 5,195,935 | A | 3/1993 | Fencel |

(Continued)

FOREIGN PATENT DOCUMENTS

| | | |
|---|---|---|
| DE | 229712 | 1/1911 |

(Continued)

OTHER PUBLICATIONS

Geartrends Fitness 2007 edition, available on information and belief at least as early as Jun. 1, 2007 (6 pages).

(Continued)

*Primary Examiner*—Loan H Thanh
*Assistant Examiner*—Oren Ginsberg
(74) *Attorney, Agent, or Firm*—Workman Nydegger

(57) ABSTRACT

An elliptical exercise machine with adjustable foot motion is provided. The elliptical exercise machine, which is adjustable to yield different elliptical paths selectable by a user, comprises a frame, a drive assembly situated on the frame, first and second link arms, the first end of each link arm being rotatably connected to the drive assembly, first and second reciprocating foot supports, the first end of each foot support being pivotally interconnected to the frame, and first and second brackets, wherein the first bracket adjustably connects the first link arm to the first foot support, and wherein the second bracket adjustably connects the second link arm to the second foot support.

32 Claims, 13 Drawing Sheets

U.S. PATENT DOCUMENTS

| | | | | |
|---|---|---|---|---|
| 5,242,343 | A | 9/1993 | Miller | |
| 5,279,531 | A | 1/1994 | Jen-Huey | |
| D344,112 | S | 2/1994 | Smith | |
| 5,290,211 | A | 3/1994 | Stearns | |
| 5,299,993 | A | 4/1994 | Habing | |
| 5,322,491 | A | 6/1994 | Wanzer et al. | |
| D336,141 | S | 8/1994 | Husted et al. | |
| 5,336,141 | A | 8/1994 | Vittone | |
| 5,352,169 | A | 10/1994 | Eschenbach | |
| 5,383,829 | A | 1/1995 | Miller | |
| D356,128 | S | 3/1995 | Smith et al. | |
| 5,415,607 | A | 5/1995 | Carpenter | |
| 5,419,751 | A | 5/1995 | Byrd et al. | |
| 5,423,729 | A | 6/1995 | Eschenbach | |
| 5,435,799 | A | 7/1995 | Lundin | |
| 5,435,801 | A | 7/1995 | Hung | |
| D367,689 | S | 3/1996 | Wilkinson et al. | |
| 5,499,956 | A | 3/1996 | Habing et al. | |
| 5,518,473 | A | 5/1996 | Miller | |
| 5,527,245 | A | 6/1996 | Dalebout et al. | |
| 5,527,246 | A | 6/1996 | Rodgers | |
| 5,529,554 | A | 6/1996 | Eschenbach | |
| 5,529,555 | A | 6/1996 | Rodgers | |
| 5,540,637 | A | 7/1996 | Rodgers | |
| 5,549,526 | A | 8/1996 | Rodgers | |
| 5,562,574 | A | 10/1996 | Miller | |
| 5,573,480 | A | 11/1996 | Rodgers | |
| 5,577,985 | A | 11/1996 | Miller | |
| 5,591,107 | A | 1/1997 | Rodgers | |
| 5,593,371 | A | 1/1997 | Rodgers | |
| 5,593,372 | A | 1/1997 | Rodgers | |
| 5,595,553 | A | 1/1997 | Rodgers | |
| 5,595,556 | A | 1/1997 | Dalebout et al. | |
| 5,611,756 | A | 3/1997 | Miller | |
| 5,611,757 | A | 3/1997 | Rodgers | |
| 5,611,758 | A | 3/1997 | Rodgers | |
| 5,616,103 | A | 4/1997 | Lee | |
| 5,626,542 | A | 5/1997 | Dalebout et al. | |
| 5,637,058 | A | 6/1997 | Rodgers | |
| D380,509 | S | 7/1997 | Wilkinson et al. | |
| 5,653,662 | A | 8/1997 | Rodgers | |
| D384,118 | S | 9/1997 | Deblauw | |
| 5,672,140 | A | 9/1997 | Watterson et al. | |
| 5,683,333 | A | 11/1997 | Rodgers | |
| 5,685,804 | A | 11/1997 | Whan-Tong et al. | |
| 5,690,589 | A | 11/1997 | Rodgers | |
| 5,695,434 | A | 12/1997 | Dalebout et al. | |
| 5,695,435 | A | 12/1997 | Dalebout et al. | |
| 5,707,320 | A | 1/1998 | Yu | |
| 5,707,321 | A | 1/1998 | Maresh | |
| 5,722,922 | A | 3/1998 | Watterson et al. | |
| 5,738,614 | A | 4/1998 | Rodgers, Jr. | |
| 5,743,834 | A * | 4/1998 | Rodgers, Jr. | 482/57 |
| 5,755,642 | A | 5/1998 | Miller | |
| 5,766,113 | A | 6/1998 | Rodgers, Jr. | |
| 5,772,558 | A | 6/1998 | Rodgers, Jr. | |
| 5,779,599 | A | 7/1998 | Chen | |
| 5,782,722 | A | 7/1998 | Sands et al. | |
| 5,788,609 | A | 8/1998 | Miller | |
| 5,788,610 | A | 8/1998 | Eschenbach | |
| 5,792,026 | A | 8/1998 | Maresh et al. | |
| 5,795,268 | A | 8/1998 | Husted | |
| 5,813,949 | A | 9/1998 | Rodgers, Jr. | |
| 5,823,917 | A | 10/1998 | Chen | |
| 5,830,113 | A | 11/1998 | Coody et al. | |
| 5,830,114 | A | 11/1998 | Halfen et al. | |
| 5,833,582 | A | 11/1998 | Chen | |
| 5,836,854 | A | 11/1998 | Kuo | |
| D403,033 | S | 12/1998 | Husted et al. | |
| 5,846,166 | A | 12/1998 | Kuo | |
| 5,857,941 | A | 1/1999 | Maresh et al. | |
| 5,860,893 | A | 1/1999 | Watterson et al. | |
| 5,860,895 | A | 1/1999 | Lee | |
| 5,873,608 | A | 2/1999 | Tharp et al. | |
| 5,897,460 | A | 4/1999 | McBride et al. | |
| 5,899,834 | A | 5/1999 | Dalebout et al. | |
| 5,904,637 | A | 5/1999 | Kuo | |
| 5,911,649 | A | 6/1999 | Miller | |
| 5,913,751 | A | 6/1999 | Eschenbach | |
| 5,916,064 | A | 6/1999 | Eschenbach | |
| 5,919,118 | A | 7/1999 | Stearns et al. | |
| 5,924,962 | A | 7/1999 | Rodgers, Jr. | |
| D413,366 | S | 8/1999 | Husted | |
| 5,938,567 | A | 8/1999 | Rodgers, Jr. | |
| 5,938,570 | A | 8/1999 | Maresh | |
| 5,944,638 | A | 8/1999 | Maresh et al. | |
| 5,947,872 | A | 9/1999 | Ryan et al. | |
| 5,951,449 | A | 9/1999 | Oppriecht | |
| 5,957,814 | A | 9/1999 | Eschenbach | |
| 5,961,423 | A | 10/1999 | Sellers | |
| 5,997,445 | A | 12/1999 | Maresh et al. | |
| 6,001,046 | A | 12/1999 | Chang | |
| 6,004,244 | A | 12/1999 | Simonson | |
| 6,007,462 | A | 12/1999 | Chen | |
| 6,019,710 | A | 2/2000 | Dalebout et al. | |
| 6,024,676 | A | 2/2000 | Eschenbach | |
| 6,027,431 | A | 2/2000 | Stearns et al. | |
| 6,030,319 | A | 2/2000 | Wu | |
| 6,030,320 | A | 2/2000 | Stearns et al. | |
| 6,042,512 | A | 3/2000 | Eschenbach | |
| 6,045,487 | A | 4/2000 | Miller | |
| 6,099,439 | A | 8/2000 | Ryan et al. | |
| 6,106,439 | A | 8/2000 | Boland | |
| 6,123,649 | A | 9/2000 | Lee et al. | |
| 6,123,650 | A | 9/2000 | Birrell | |
| 6,135,927 | A | 10/2000 | Lo | |
| 6,146,313 | A | 11/2000 | Whan-Tong et al. | |
| 6,149,551 | A | 11/2000 | Pyles et al. | |
| 6,165,107 | A | 12/2000 | Birrell | |
| 6,171,217 | B1 | 1/2001 | Cutler | |
| 6,176,814 | B1 | 1/2001 | Ryan et al. | |
| 6,190,289 | B1 | 2/2001 | Pyles et al. | |
| 6,196,948 | B1 * | 3/2001 | Stearns et al. | 482/52 |
| 6,206,804 | B1 | 3/2001 | Maresh | |
| 6,210,305 | B1 | 4/2001 | Eschenbach | |
| 6,217,486 | B1 | 4/2001 | Rosenow | |
| 6,248,044 | B1 | 6/2001 | Stearns et al. | |
| 6,261,209 | B1 | 7/2001 | Coody | |
| 6,277,055 | B1 | 8/2001 | Birrell et al. | |
| 6,315,702 | B1 | 11/2001 | Ikonomopoulos | |
| 6,338,698 | B1 | 1/2002 | Stearns et al. | |
| 6,361,476 | B1 | 3/2002 | Eschenbach | |
| 6,368,252 | B1 | 4/2002 | Stearns | |
| 6,390,953 | B1 | 5/2002 | Maresh et al. | |
| 6,398,695 | B2 | 6/2002 | Miller | |
| 6,409,632 | B1 | 6/2002 | Eschenbach | |
| 6,422,976 | B1 | 7/2002 | Eschenbach | |
| 6,422,977 | B1 | 7/2002 | Eschenbach | |
| 6,436,007 | B1 | 8/2002 | Eschenbach | |
| 6,440,042 | B2 | 8/2002 | Eschenbach | |
| 6,482,132 | B2 | 11/2002 | Eschenbach | |
| 6,500,096 | B1 | 12/2002 | Farney | |
| 6,544,147 | B1 | 4/2003 | Wang et al. | |
| 6,551,217 | B2 | 4/2003 | Kaganovsky | |
| 6,582,343 | B2 | 6/2003 | Lin et al. | |
| 6,612,969 | B2 | 9/2003 | Eschenbach | |
| 6,645,125 | B1 | 11/2003 | Stearns et al. | |
| 6,685,607 | B1 | 2/2004 | Olson | |
| 6,730,002 | B2 | 5/2004 | Hald et al. | |
| 6,749,540 | B1 | 6/2004 | Pasero et al. | |
| 6,752,744 | B2 | 6/2004 | Arnold et al. | |
| 6,758,790 | B1 | 7/2004 | Ellis | |
| 6,783,481 | B2 | 8/2004 | Stearns et al. | |
| 6,786,669 | B2 * | 9/2004 | Tsui et al. | 403/322.2 |

| | | | | |
|---|---|---|---|---|
| 6,821,232 | B1 | 11/2004 | Wang et al. | |
| 6,830,538 | B2 | 12/2004 | Eschenbach | |
| 6,855,093 | B2 | 2/2005 | Anderson et al. | |
| 6,875,160 | B2 | 4/2005 | Watterson et al. | |
| 6,949,053 | B1 | 9/2005 | Stearns et al. | |
| 6,949,054 | B1 | 9/2005 | Stearns et al. | |
| 7,025,711 | B2 | 4/2006 | Eschenbach | |
| 7,033,305 | B1 | 4/2006 | Stearns et al. | |
| 7,060,005 | B2 | 6/2006 | Carlsen et al. | |
| 7,097,592 | B2 | 8/2006 | Wang | |
| 7,169,087 | B2 | 1/2007 | Ercanbrack et al. | |
| 7,192,388 | B2 | 3/2007 | Dalebout et al. | |
| 7,201,707 | B1 | 4/2007 | Moon | |
| 7,214,167 | B2 | 5/2007 | Stearns et al. | |
| 7,278,955 | B2 | 10/2007 | Giannelli et al. | |
| 2002/0086779 | A1 | 7/2002 | Wilkinson | |
| 2002/0198084 | A1 | 12/2002 | Stearns et al. | |
| 2003/0045403 | A1 | 3/2003 | Watterson et al. | |
| 2003/0083177 | A1* | 5/2003 | Tung | 482/51 |
| 2003/0092532 | A1 | 5/2003 | Giannelli et al. | |
| 2004/0077463 | A1 | 4/2004 | Rodgers, Jr. | |
| 2004/0132583 | A1 | 7/2004 | Ohrt et al. | |
| 2004/0157706 | A1 | 8/2004 | Miller | |
| 2004/0162191 | A1* | 8/2004 | Ercanbrack et al. | 482/52 |
| 2004/0198561 | A1 | 10/2004 | Corbalis et al. | |
| 2004/0224825 | A1 | 11/2004 | Giannelli et al. | |
| 2005/0009668 | A1 | 1/2005 | Savettiere et al. | |
| 2005/0026752 | A1* | 2/2005 | Lull et al. | 482/57 |
| 2005/0101463 | A1 | 5/2005 | Chen | |
| 2005/0130807 | A1 | 6/2005 | Cutler et al. | |
| 2005/0164837 | A1 | 7/2005 | Anderson et al. | |
| 2005/0181912 | A1* | 8/2005 | Eschenbach | 482/52 |
| 2005/0202939 | A1* | 9/2005 | Lull et al. | 482/57 |
| 2005/0209059 | A1 | 9/2005 | Crawford et al. | |
| 2006/0019804 | A1 | 1/2006 | Young | |
| 2006/0035754 | A1 | 2/2006 | Giannelli et al. | |
| 2006/0035755 | A1 | 2/2006 | Dalebout et al. | |
| 2006/0040794 | A1 | 2/2006 | Giannelli et al. | |
| 2006/0166791 | A1* | 7/2006 | Liao et al. | 482/52 |
| 2006/0217236 | A1 | 9/2006 | Watterson et al. | |
| 2006/0234838 | A1 | 10/2006 | Dalebout et al. | |
| 2006/0247103 | A1 | 11/2006 | Stearns et al. | |
| 2006/0287161 | A1 | 12/2006 | Dalebout et al. | |
| 2007/0042871 | A1* | 2/2007 | Wu et al. | 482/52 |
| 2007/0060449 | A1 | 3/2007 | Lo | |
| 2007/0060450 | A1 | 3/2007 | Lo | |
| 2007/0117683 | A1 | 5/2007 | Ercanbrack et al. | |
| 2007/0123393 | A1 | 5/2007 | Giannelli et al. | |
| 2007/0123394 | A1 | 5/2007 | Ercanbrack et al. | |
| 2007/0129217 | A1 | 6/2007 | Giannelli et al. | |
| 2007/0129218 | A1 | 6/2007 | Dalebout et al. | |
| 2007/0179023 | A1* | 8/2007 | Dyer | 482/52 |
| 2007/0202995 | A1 | 8/2007 | Roman et al. | |
| 2007/0202999 | A1 | 8/2007 | Giannelli et al. | |
| 2008/0032869 | A1 | 2/2008 | Pacheco et al. | |
| 2008/0051260 | A1 | 2/2008 | Simonson et al. | |
| 2008/0153674 | A9 | 6/2008 | Dalebout et al. | |
| 2008/0167163 | A9 | 7/2008 | Dalebout et al. | |
| 2008/0200314 | A1 | 8/2008 | Dalebout et al. | |

FOREIGN PATENT DOCUMENTS

| | | |
|---|---|---|
| FR | 498.150 | 6/1916 |
| WO | WO95/00209 | 1/1995 |
| WO | WO96/08292 | 3/1996 |

OTHER PUBLICATIONS

CYBEX Cross-Training, "CYBEXceptional," including pages relating to Nova 7 award, Cybex Arc Trainer Nova 7 2004 & 2005 "Best Product of the Year," and "Total Body Arc Trainer The Evolution of Fitness Continues," printed Jun. 14, 2006 (4 pages).

www.cybexintl.com/Products, "Total Body Arc Trainer," printed Jun. 14, 2006 (1 page).

www.cybexintl.com/Products, Arc Trainer, printed Jun. 14, 2006 (1 page).

www.cybexinternational.com, "Total Body Arc Trainer" and "Total Body Arc Trainer" Product #630A, available on information and belief at least as early as Apr. 4, 2007 (2 total pages).

www.cybexinternational.com, "Self Powered Total Body Arc," printed Apr. 4, 2007 (1 page).

www.cybexinternational.com, "425A Arc Trainer," printed Apr. 4, 2007 (1 page).

www.cybexinternational.com, "Home Arc Trainer," printed Apr. 4, 2007 (1 page).

www.nautilus.com, Nautilus® EV718 Pro Series Elliptical, printed Jun. 21, 2006 (2 pages).

"Arc Trainer Specifications," copyright 2005 (1 page).

Sports Authority Newspaper Advertisement, "All Ellipticals and Bikes on Sale," Deseret Morning News, Dec. 6, 2006, one page.

Operations Manual, Q35/Q35e/Pro35, Octane Fitness, 48 pages, copyright 2004.

Operations Manual, Q35, Octane Fitness, 28 pages, copyright 2006.

Assembly Manual, Q35, Octane Fitness, 12 pages, copyright 2006.

Brochure: "EFX 5.37 Elliptical Fitness Cross Trainer," 2 pages, copyright 2007.

Brochure: "EFX 5.17i Elliptical Fitness Cross Trainer," 2 pages, copyright 2006.

www.precor.com, Internet pages relating to EFX Elliptical Fitness Cross Trainer, printed Jan. 3, 2008, 5 pages.

Picture of Summit Trainer Exercise Device, which was available on information and belief at least as early as Jul. 2006, 1 page.

www.us.commercial.lifefitness.com, "Summit Trainers," printed Oct. 17, 2006 (3 pages).

Internet archive for www.us.commercial.lifefitness.com, at http://web.archive.org/web/20061016230321/us.commercial.lifefitness.com/, "Summit Trainers," available on information and belief at least as early as Oct. 16, 2006 (3 pages).

"95Le Summit Trainer" and "95Le Summit Trainer Specifications," copyright 2006 (2 pages).

www.uk.corporate.lifefitness.com, "Life Fitness Joins as Associate Sponsor of the 2006 LaSalle Bank Chicago Marathon," printed on Jan. 4, 2008 (2 pages).

Brochure: "Summit Trainers, The latest innovation in cardiovascular exercise," 3 pages, available on information and belief at least as early as Jul. 17, 2007 (includes brochure pages 38-41, 66).

Brochure: "Reach Your Summit," 7 pages, available on information and belief at least as early as Nov. 1, 2006.

Operations Manual, 95Le Summit Trainer, LifeFitness, 53 pages, copyright 2006.

Operations Manual, 95Li Summit Trainer, LifeFitness, 39 pages, copyright 2006.

Assembly Instructions, 95Li Summit Trainer, LifeFitness, 10 pages, available on information and belief at least as early as Dec. 18, 2006.

LifeFitness, "Biomechanical Research Presents Benefits of New Summit Trainer," copyright 2006 (2 pages).

Vision Fitness-About Our Ellipticals, www.visionfitness.com, printed Sep. 13, 2005.

Photographs of Octane Fitness Exercise Device, available on information and belief at least as early as Sep. 2006, 8 photographs (3 pages).

Horizon Series E30 E20, printed on Jul. 27, 2004 from www.horizonfitness.com/horizon-series/ellipticals/e20.php, (1 page).

Horizon Elliptical Specs, printed on Jul. 27, 2004 from www.horizonfitness.com/horizon-series/ellipticals/elliptical-spec.php, (1 page).

User's Manual, NordicTrack CX 998, Model No. 70950, 28 pages, available on information and belief at least as early as Jan. 29, 2005.

User's Manual, NordicTrack EX 1000 Commercial Pro, Model No. NTEL 4255.1, 28 pages, available on information and belief at least as early as May 24, 2006.

User's Manual, Pro-Form XP 520 Razor Elliptical Exerciser, Model No. 831.23744.0, 28 pages, available on information and belief at least as early as Jun. 19, 2007.

Operations Manual, Q47/Q47e/Q47ce Exercise Device, Octane Fitness, 52 pages, copyright 2007.

Quality Control Checklist, Q47 Deluxe Console, Document No. 102389-001 Rev. A, dated Jun. 13, 2007, 1 page.
Quality Control Checklist, Q47 Base, Document No. 102387-001 Rev. A, dated Jun. 13, 2007, 1 page.
Octane Fitness table listing Q47 Specs, Q37 Specs, and Q35 Specs, available on information and belief at least as early as Sep. 2007, 1 page.
Internet archive for www.octanefitness.com, "Octane Fitness: Front Page," available on information and belief at least as early as Jun. 29, 2005 (1 page).
Internet archive for www.octanefitness.com, "Home Products," available on information and belief at least as early as Jun. 12, 2005 (1 page).
Internet archive for www.octanefitness.com, "Press Room," available on information and belief at least as early as Dec. 20, 2005 (1 page).
Internet archive for www.octanefitness.com, "Research," available on information and belief at least as early as Sep. 8, 2005 (1 page).
Internet archive for www.octanefitness.com, "Service," and "Club Products," available on information and belief at least as early as Apr. 9, 2005 (2 pages).
Internet archive for www.octanefitness.com, Testimonial pages, available on information and belief at least as early as Oct. 23, 2005 (11 pages).
Internet archive for www.octanefitness.com, pages entitled "Feel" (4 pages) and "Electronics" (2 pages), available on information and belief at least as early as Jan. 3, 2006 (6 total pages).
Internet archive for www.octanefitness.com, entitled "Feel," available on information and belief at least as early as Dec. 22, 2005 (1 page).
Internet archive for www.octanefitness.com, pages entitled "Why are elliptical trainers so popular," "Effectiveness of Elliptical Trainers," Impact your life, not your body!"Total Body Workout," "Minimal Maintenance," "Small Footprint," "Retailers," available on information and belief at least as early as Dec. 31, 2005 (7 pages).
Internet archive for www.octanefitness.com, pages entitled, "Elliptical Cross Training," (3 pages), "Body-Mapping Ergonomics," (2 pages) and "Elliptical Trainers and Pregnancy," (3 pages) available on information and belief at least as early as Dec. 26, 2005 (8 total pages).
Internet archive for www.octanefitness.com, pages entitled, "White Papers," "Company History," "Electronics," "Programs Q45/Q45e," "ProgramsPro35," "Programs Pro350/Pro350XL," "X-Mode+ Pro35/Pro350/Pro350XL," "X-Mode Q35 and Q45," "X-Mode+ Q35e/Q45e," "X-Mode+ Pro35/Pro350/Pro350XL," "SmartStride Q45/Q45e," "SmartStride Q45/Q45e," "Elliptical Shopping Guide," "Specs," (2 pages), Consumer Guide Best Buy, "Octane Q45e," Consumer Guide Best Buy, "Octane Q35e," "Heart Rate Training," (3 pages), available on information and belief at least as early as Mar. 14, 2006 (20 total pages).

* cited by examiner

ELLIPTICAL EXERCISE MACHINE WITH ADJUSTABLE FOOT MOTION

BACKGROUND OF THE INVENTION

1. The Field of the Invention

This invention generally relates to exercise equipment and, more specifically, to elliptical exercise machines.

2. The Relevant Technology

Exercise machines having alternating reciprocating foot supports configured to traverse or travel about a closed path to simulate a striding, running, walking, and/or a climbing motion for the individual using the machine are well known in the art, and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point, with the other end supported in a manner configured to cause the reciprocating foot support to travel or traverse a closed path, such as a reciprocating elliptical or oblong path or other similar geometric outline. Therefore, upon operation of the exercise machine, each reciprocating foot support is caused to travel or traverse the closed path, thereby simulating a striding motion of the user for exercise purposes. The reciprocating foot supports are configured to be out of phase with one another by 180 degrees in order to simulate a proper and natural alternating stride motion.

An individual may utilize an elliptical exercise machine by placing his or her feet onto the reciprocating foot supports. The individual may then actuate the exercise machine for any desired length of time to cause the reciprocating foot supports to repeatedly travel their respective closed paths, which action effectively results in a series of strides achieved by the individual to obtain exercise, with a low-impact advantage. An elliptical exercise machine may further comprise mechanisms or systems for increasing the resistance of the motion. In addition, the reciprocating motion of the feet to achieve a series of strides may be complemented by a reciprocating movement of the arms, whether assisted by the exercise machine via a suitably configured mechanism or system, or unassisted.

Although elliptical exercise machines may comprise mechanisms or systems for increasing the resistance of motion, there is no practical way to readily adjust the level of exercise on a given machine. It is, therefore, an object of the present invention to provide a mechanism to readily vary the level of exercise on an elliptical exercise machine.

BRIEF SUMMARY OF THE INVENTION

An elliptical exercise machine with adjustable foot motion is provided. The elliptical exercise machine, which is adjustable to yield different elliptical paths selectable by a user, comprises a frame, a drive assembly situated on the frame, first and second link arms, the first end of each link arm being rotatably connected to the drive assembly, first and second reciprocating foot supports, the first end of each foot support being pivotally interconnected to the frame, and first and second brackets, wherein the first bracket adjustably connects the first link arm to the first foot support, and wherein the second bracket adjustably connects the second link arm to the second foot support.

Each bracket has a forward position and a rearward position, wherein each position yields a different elliptical path for each foot support and thereby a different foot motion for the user. In some embodiments, the user adjusts each bracket and thereby changes the elliptical path by either grabbing a knob affixed to each bracket. In other embodiments, the user merely adjusts each bracket and thereby changes the elliptical by grabbing and moving a foot pad that is situated on each foot support.

The frame further comprises a base support structure and an upright support structure. Further, in certain embodiments, the base support structure has two sides and has a guide rail on each side, and the second end of each link arm has a roller rotatably attached to it such that the second end of each link arm can engage the respective guide rail of the base support structure.

In certain embodiments of the elliptical exercise machine of the present invention, each bracket has a first section and a second section, the first section of the each bracket being pivotally connected to each respective foot support and the second section of the each bracket being pivotally connected to each respective link arm such that the each bracket movably connects each respective link arm to each respective foot support.

In other embodiments of the elliptical exercise machine of the present invention, where each bracket pivotally connects each link arm with each foot support, the first bracket comprises a first movable section and a first clamp pivotally linked together by a first bracket plate, and the second bracket comprises a second movable section and a second clamp pivotally linked together by a second bracket plate.

BRIEF DESCRIPTION OF THE DRAWINGS

In order that the manner in which the above-recited and other advantages and objects of the invention are obtained, a more particular description of the invention briefly described above will be rendered by reference to specific embodiments thereof that are illustrated in the appended drawings. These drawings depict only typical embodiments of the invention. They are not, therefore, to be considered to be limiting of its scope. The invention will be described and explained with additional specificity and detail through the use of the accompanying drawings in which.

DETAILED DESCRIPTION OF THE PREFERRED EMBODIMENTS

The following detailed description of exemplary embodiments of the invention makes reference to the accompanying drawings, which show, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in the figures, is not intended to limit the scope of the invention, as claimed, it is presented for purposes of illustration only and to describe the features and characteristics of the present invention, to set forth the best mode of operation of the invention, and to sufficiently enable one skilled in the art to practice the invention. Accordingly, the scope of the present invention is to be defined solely by the appended claims. The following detailed description and exemplary embodiments of the invention will be best understood by reference to the accompanying drawings, wherein the elements and features of the invention are designated by numerals throughout.

The present invention describes and features an exercise machine, and particularly an elliptical or elliptical-type exercise machine that provides a mechanism to vary the level of exercise. Further, the disclosed mechanism is very simple to use. With reference to the accompanying drawings, advantages of the present invention will be apparent in light of the detailed description set forth below. These advantages are not meant to be limiting in any way. Indeed, other than those specifically recited herein, one skilled in the art will appreciate that other advantages may be realized, upon practicing the present invention.

Figure 1:
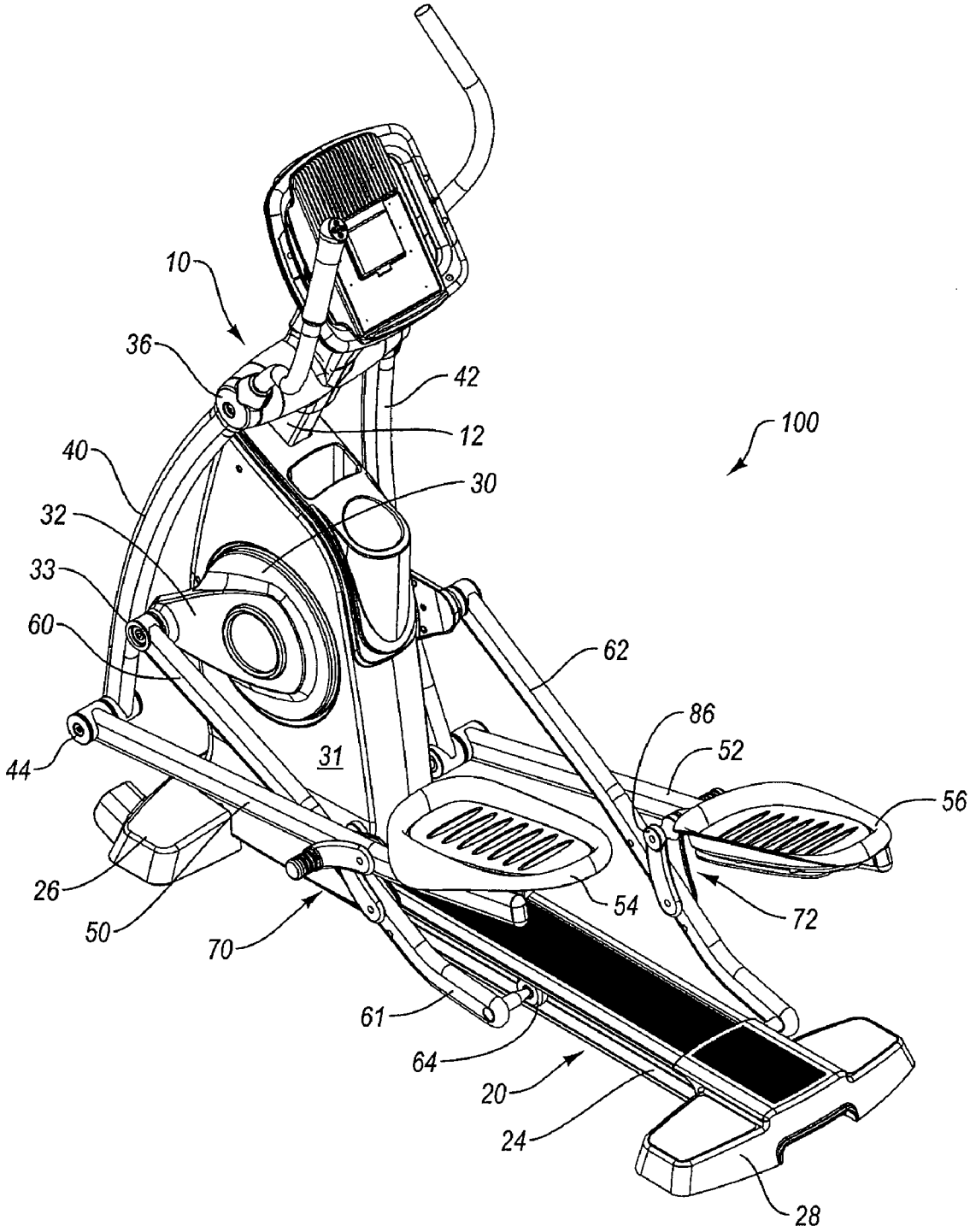
FIG. 1 illustrates a perspective view of a front mechanism elliptical exercise machine according to the present invention.

FIG. 1 shows a perspective view of a front mount or front mechanical-type elliptical exercise machine 100 according to one exemplary embodiment of the present invention. The elliptical exercise machine 100 comprises a frame 10, a drive assembly 30, first and second swing arms 40 and 42, first and second foot supports 50 and 52, first and second link arms 60 and 62, and first and second double brackets 70 and 72. The frame 10 comprises an upright support structure 12 and a base support structure 20, which has first and second support feet 26 and 28. As shown in FIG. 1, the drive assembly 30 is enclosed in a housing 31 that is situated on part of each of the base support structure 20 and the upright support structure 12.

With respect to the left hand side of the elliptical exercise machine 100, which is identical to the right hand side except that it is offset by 180 degrees, the upper end of the first swing arm 40 is pivotally connected to the upright support structure 12 at a pivot point 36. The lower end of the first swing arm 40 is pivotally connected to the forward end of the first foot support 50 at a pivot point 44. The first foot support 50 is thereby pivotally connected to the first link arm 60 by means of a bracket, the first double bracket 70. The first link arm 60 is thereby rotatably connected to a first crank arm 32 of the drive assembly 30 at a pivot point 33. Note that the forward end of the elliptical exercise machine 100 or part thereof is that toward the end of the machine 100 on which the drive assembly 30 is situated, and the rearward end or part thereof is that toward the opposite end of the machine 100.

As shown in FIG. 1, a first foot pad 54 is situated on the rearward end of the first foot support 50. Also, the double bracket 70 connects the first foot support 50 and the first link arm 60 at a point between their respective ends and at a point more proximate the rearward end of each. Further, as shown in FIG. 1, there is a roller 64 attached to the lower end 61 of the first link arm 60 so that the link arm 60 can ride along a guide rail 24 on the left side of the base support structure 20. This feature also is shown in FIG. 2.

Figure 2:
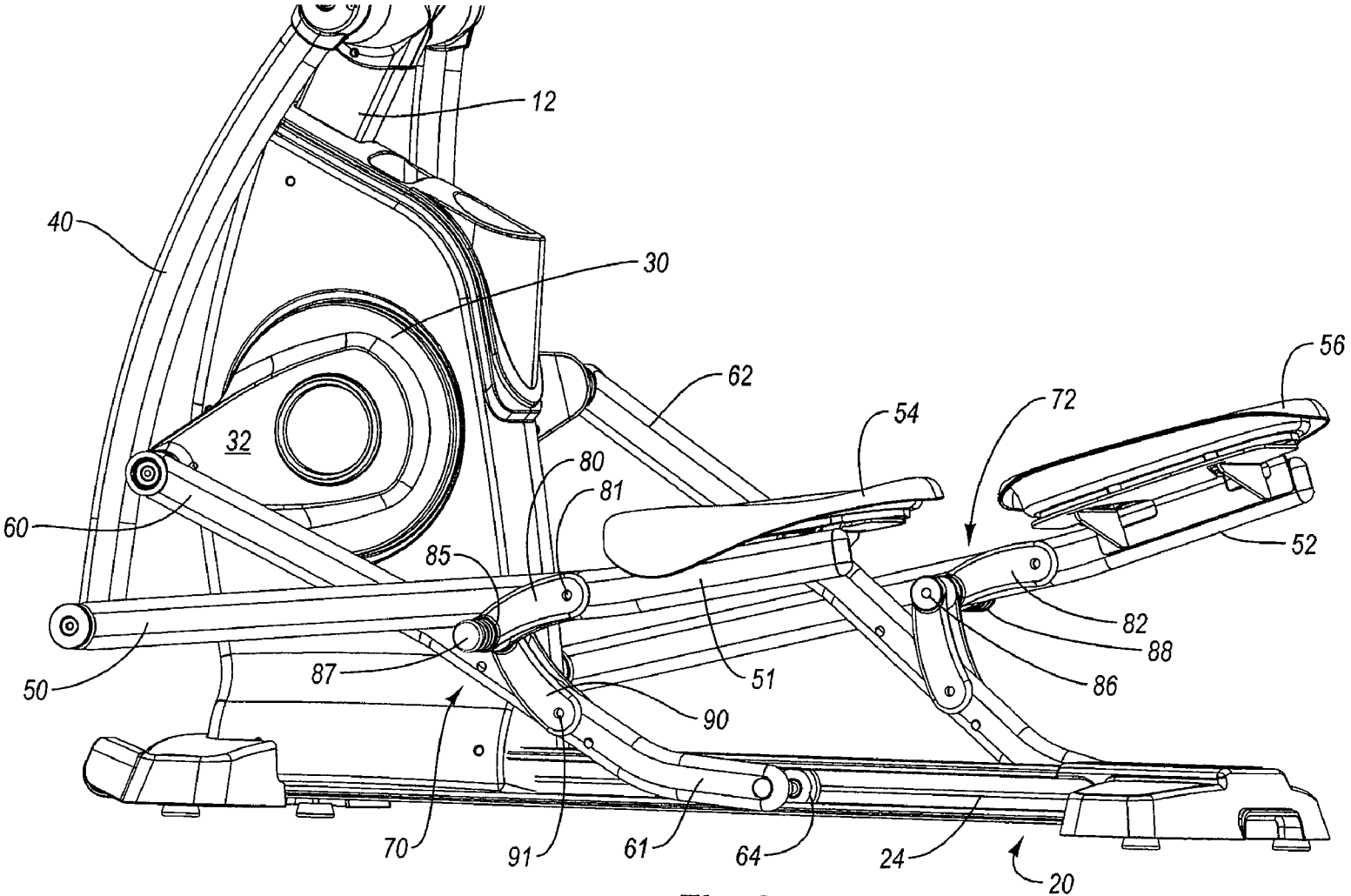
FIG. 2 illustrates a side view of the elliptical exercise machine of FIG. 1.

FIG. 2 shows an enlarged, cut-away perspective view of the bottom portion of the elliptical exercise machine of FIG. 1, illustrating the mechanisms of the double brackets 70 and 72, which are identical except for being out of phase by 180 degrees. The first double bracket 70 comprises an upper half 80 and a lower half 90 that are pivotally connected at a first bracket joint rod 85. The upper half 80 of the double bracket 70 is pivotally connected at its upper end to the first foot support 50 at pivot point 81 and the lower half 90 is pivotally connected at its lower end to the first link arm 60 at pivot point 91. When in use, the first foot support 50 rests or rides on top of the outer portion of the first bracket joint rod 85, while the bottom inner portion of the first bracket joint rod rests or rides on top of the first link arm 60. The inner and outer portions of the bracket joint rods 85 and 86 have concave surfaces to readily mate with the foot supports and link arms (as best shown in FIG. 1).

Extending outward and perpendicular from the first bracket and joint rod 85 is a first knob 87 that enables a user to position the first double bracket 70 either in a forward location or in a rearward location. As shown in FIG. 2, the first double bracket 70 and the second double bracket 72 are positioned in their forward locations. The present invention achieves adjustable foot motion by means of the double brackets 70 and 72 and their respective forward and rearward locations. In the forward location (or position), double bracket 70 causes foot support 50 and thereby foot pad 54 to travel in a more vertical path than when double bracket 70 is in its rearward location, also resulting in a path that is shorter in length. This path that the user's foot follows when the double bracket 70 is in its forward location also results in a more strenuous exercise than when the double bracket 70 is in its rearward location. In this way, the present invention provides a mechanism to readily vary the level of exercise of an elliptical machine. Further, although only a forward and rearward location for each of the double brackets 70 and 72 are disclosed, many positions are contemplated, e.g., locations that are adjustable between a forward and a rearward location.

To change the position of the double bracket 70, the exercise machine 100 should not be in use. The user grabs hold on the knob 87 and imparts pressure in either the forward or rearward direction, depending on the desired new location. Note that there may be a need to simultaneously lift up slightly on the foot support 50 to facilitate moving of knob 87 and double bracket 70. In other embodiments, the double bracket 70 can be spring loaded such that the user can merely lift up on the rearward end 51 of the foot support 50 and the spring loaded bracket will flip to the opposite or different location.

As discussed and as shown in the Figures, the double brackets 70 and 72 are designed to adjust and thereby vary the foot motion of the user of an elliptical machine. As shown, the angle between each half 80 and 90 of double bracket 70 changes not only upon adjustment from the forward location to the rearward location, but also when the elliptical exercise machine 100 is in operation. Further, in the embodiments shown in the Figures, the weight or pressure from the user keeps the double brackets 70 and 72 in their respective forward or rearward locations during operation. Specific mechanisms for maintaining the double brackets 70 and 72 in their desired locations, however, are contemplated.

Figure 3:
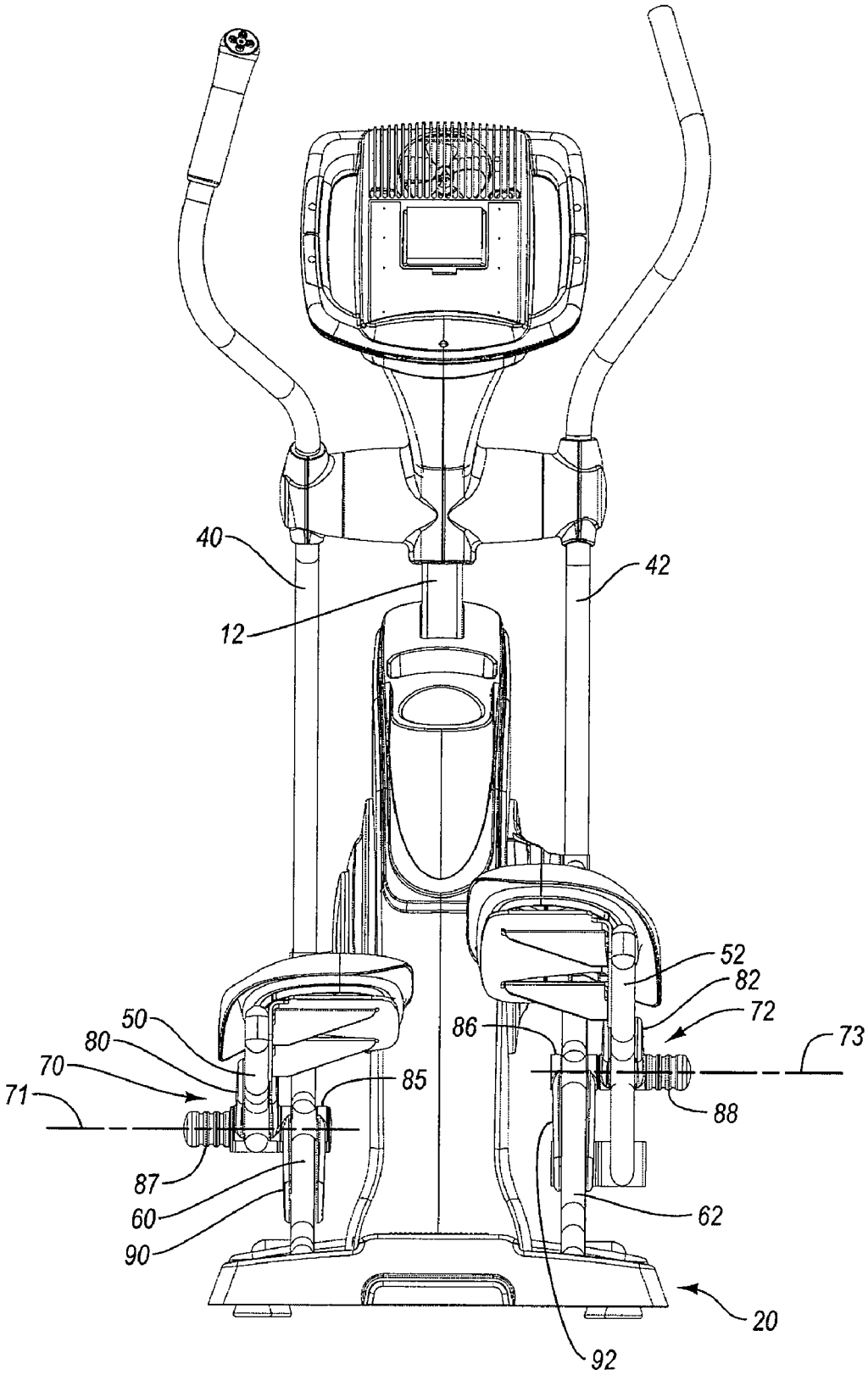
FIG. 3 illustrates an enlarged, cut-away rear view of the elliptical exercise machine of FIG. 1.

FIG. 3 shows a rear view of the elliptical exercise machine of FIG. 1. As shown in FIG. 3, each double bracket 70 and 72 is positioned in its respective forward locations. Also as shown, the halves (or sections) of double bracket 70 are pivotally connected at pivot joint rod 85, which is centered on common axis 71, which also is shared by knob 87. Similarly, the halves of double bracket 72 are pivotally connected at second pivot joint rod 86, which is centered on common axis 73, which also is shared by knob 88. Further, as shown in FIG. 3, although the respective halves 80, 90 and 82, 92 of the double brackets 70, 72 surround both sides of the respective foot supports 50, 52 and link arms 60, 62, embodiments of the double brackets 70, 72 that are positioned only on one side of the respective foot supports 50, 52 and link arms 60, 62 are contemplated.

Figure 4A:
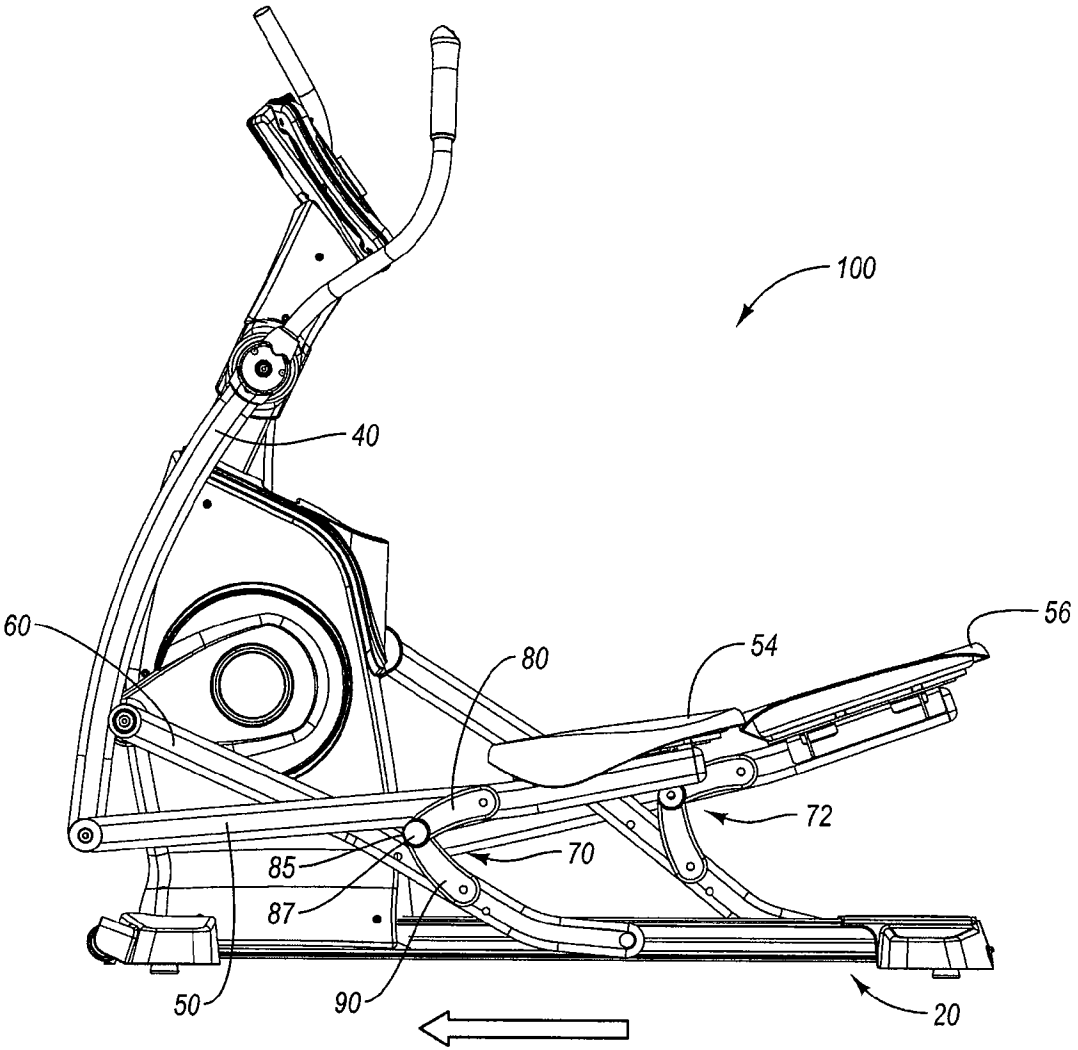
FIG. 4A illustrates a side view of the elliptical exercise machine of FIG. 1.
Figure 4B:
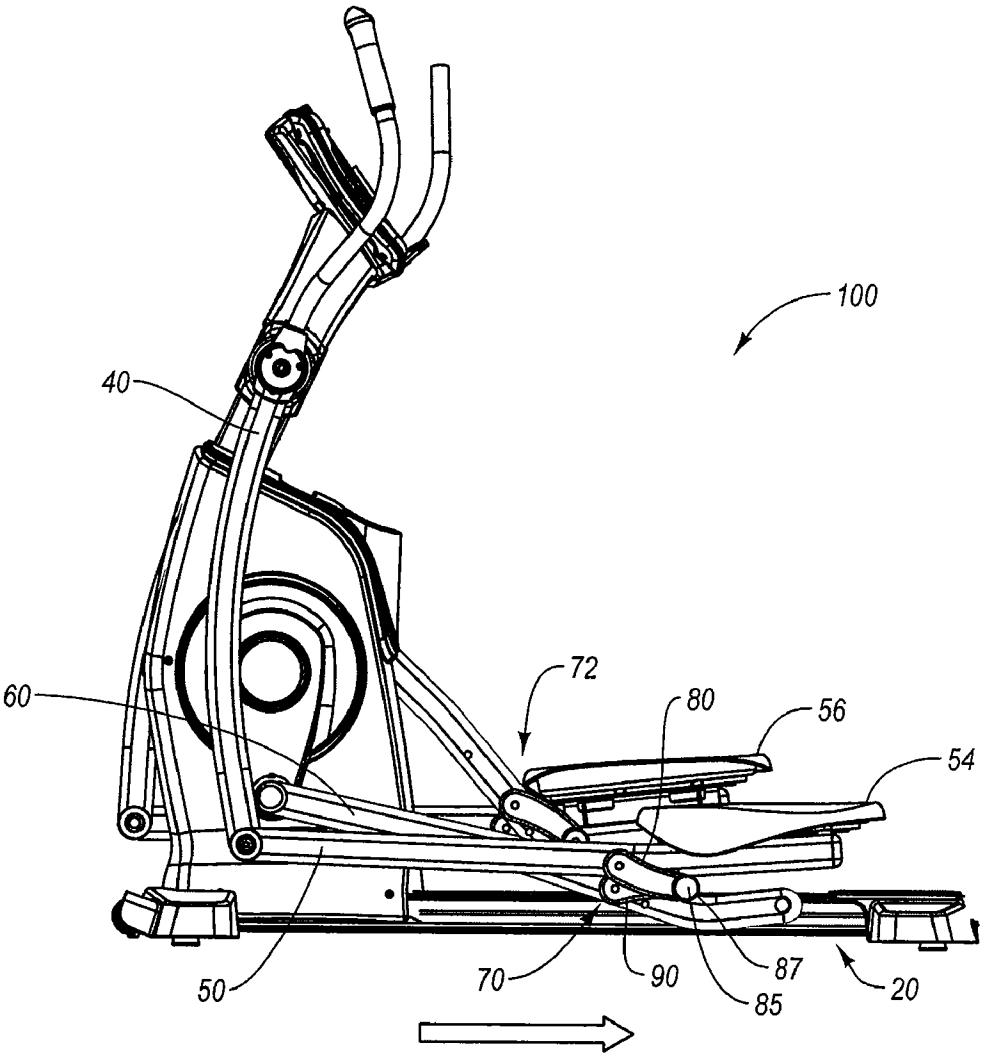
FIG. 4B illustrates another side view of the elliptical exercise machine of FIG. 1.

FIG. 4A shows a side view of the elliptical exercise machine 100 of FIG. 1. As shown in FIG. 4A, the double brackets 70 and 72 are positioned in their respective forward locations. FIG. 4B shows a side view of the elliptical exercise machine 100 of FIG. 1 with the double brackets 70 and 72 positioned in their respective rearward locations. Compared to FIG. 4A, where the double brackets 70 and 72 are in their respective forward locations, the foot pads 54 and 56 of FIG. 4B are in relatively lower and more rearward positions that those of FIG. 4A. In this way, when the double brackets 70 and 72 are positioned in their rearward locations, the elliptical path is less vertical and shorter in length than when the double brackets are in their forward locations. Changing the elliptical path in this manner changes the level of exercise. That is, a more vertical elliptical path resulting from the double brackets 70 and 72 positioned in their forward locations causes the user to undergo a more strenuous level of exercise than when the double brackets are in their rearward locations. Arrows are shown in FIGS. 4A and 4B to depict the direction the user moves the respective knobs 85 and 85 to position the double brackets 70 and 72 in their respective forward (FIG. 4A) and rearward (FIG. 4B) locations. Thus, by changing the locations of the double brackets 70 and 72, the user can readily vary the foot motion and thereby adjust the level of exercise on the elliptical exercise machine 100.

Figure 5:
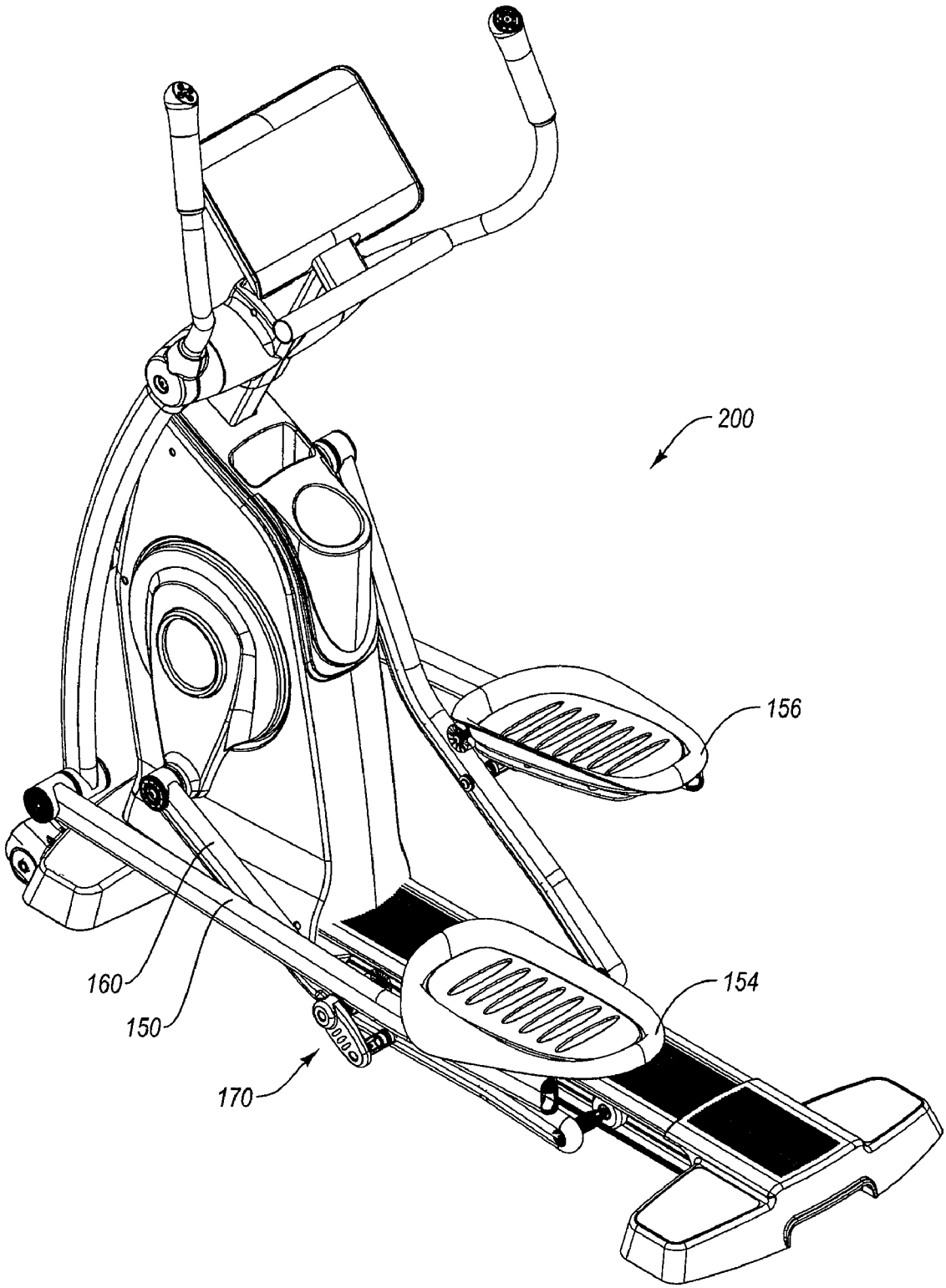
FIG. 5 illustrates a perspective view of an alternative embodiment of a front mechanism elliptical exercise machine according to the present invention.

FIG. 5 shows a perspective view of a front mount or front mechanical-type elliptical exercise machine 200 according to an alternate exemplary embodiment of the present invention. As shown in FIG. 5, the elliptical exercise machine 200 is the same as the exercise machine 100 except that the foot supports 150 and 152 of machine 200 are pivotally connected to its link arms 160 and 162 by means of respective single brackets 170 and 172, as opposed to the double brackets 70 and 72 of exercise machine 100. To change the locations of the single brackets 170 and 172, the user can merely lift up on a foot pad 154 and 156, and the brackets 170 and 172 will flip to the opposite or different location. Further, as with exercise machine 100, the left hand side of exercise machine 200 is identical to the right hand side except that it is offset by 180 degrees.

Figure 6A:
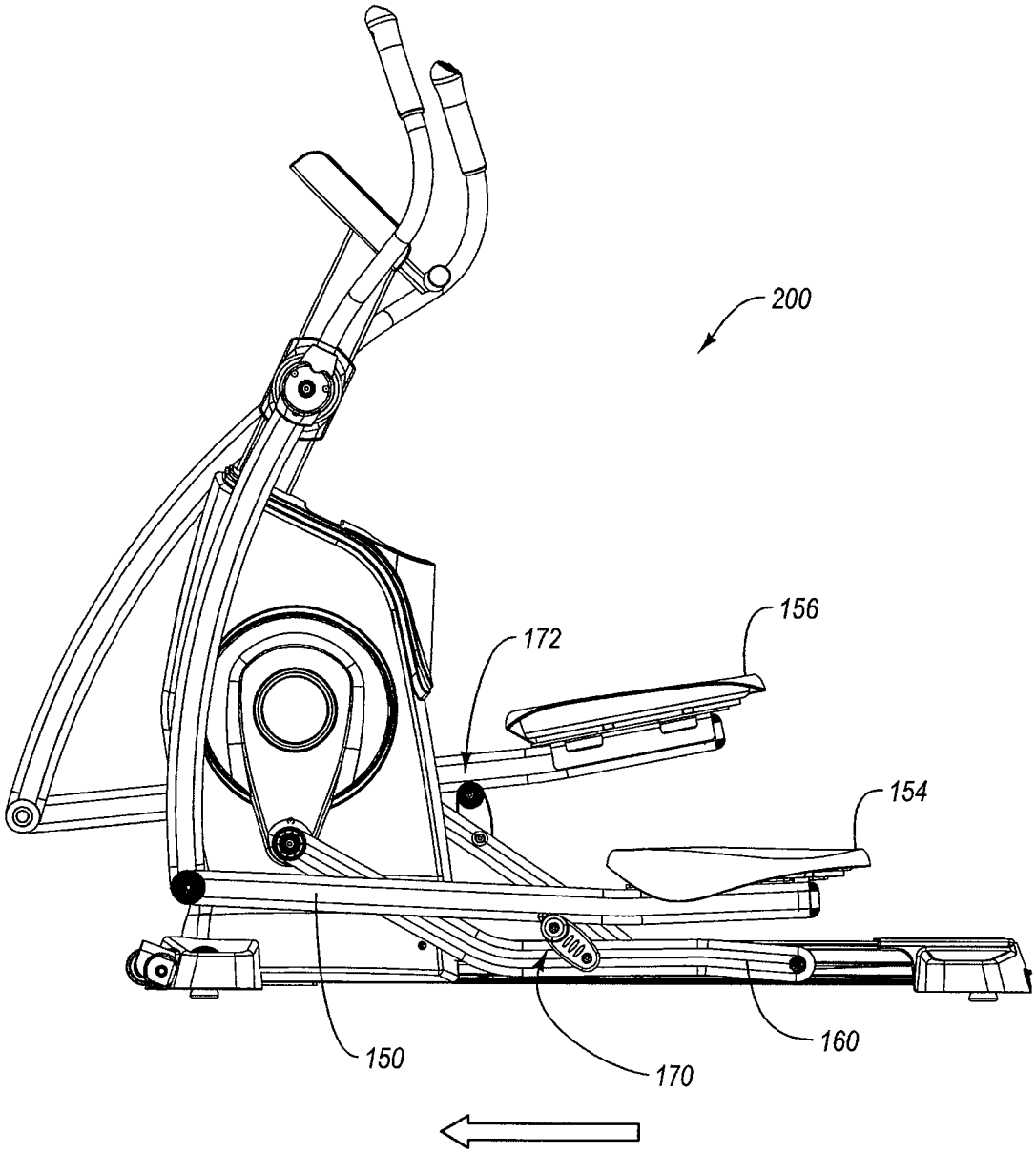
FIG. 6A illustrates a side view of the elliptical exercise machine of FIG. 5.
Figure 6B:
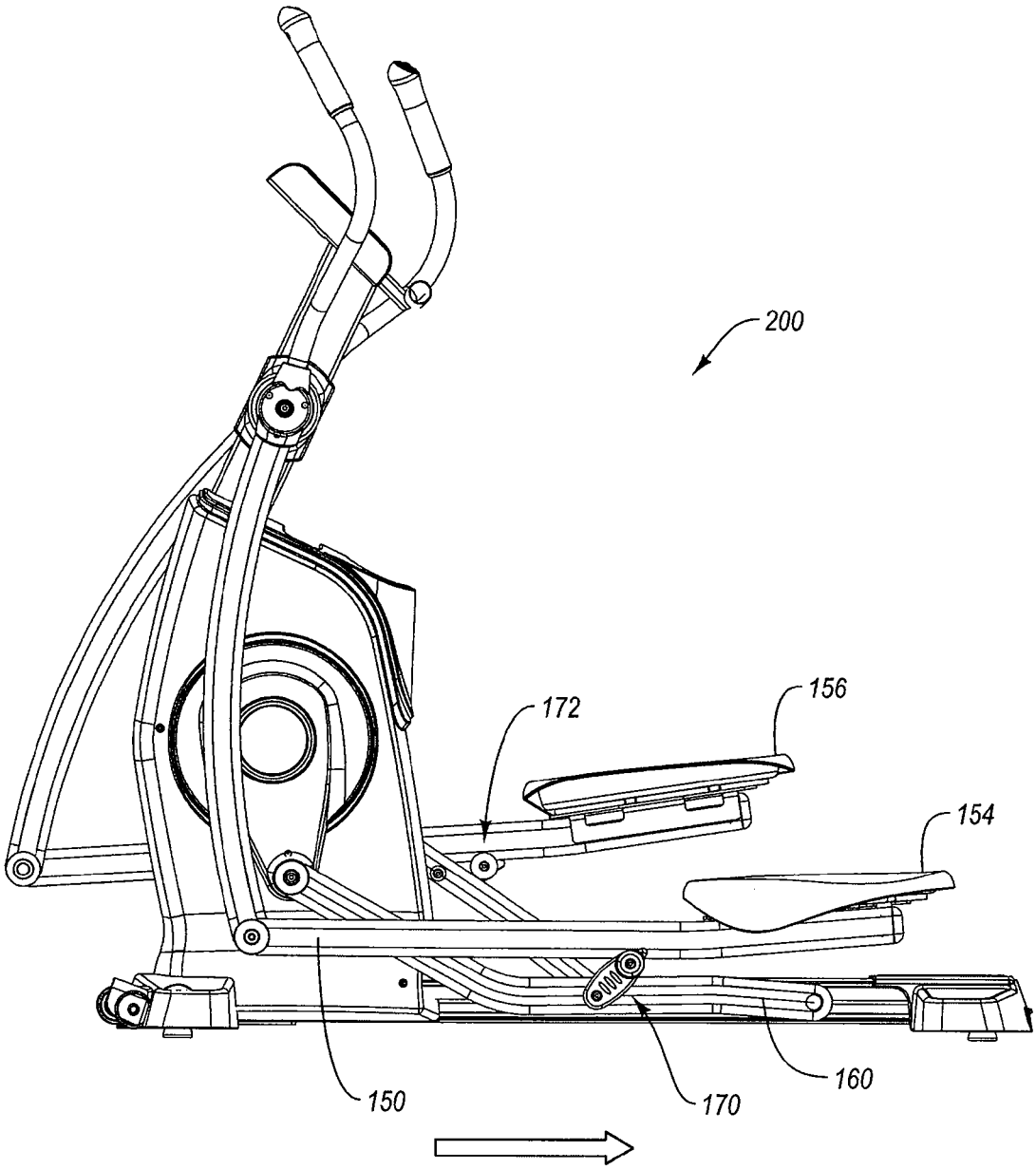
FIG. 6B illustrates another side view of the elliptical exercise machine of FIG. 5.

FIG. 6A shows a side view of the elliptical exercise machine 200 of FIG. 5. As shown in FIG. 6A, the single brackets 170 and 172 are positioned in their respective forward locations. FIG. 6B shows a side view of the elliptical exercise machine 200 of FIG. 5 with the single brackets 170 and 172 positioned in their respective rearward locations. Compared to FIG. 6A, where the single brackets 170 and 172 are in their respective forward locations, the foot pads 154 and 156 of FIG. 6B are in relatively lower and more rearward positions that those of FIG. 6A. In this way, when the single brackets 170 and 172 are positioned in their rearward locations, the elliptical path is less vertical and shorter in length than when the double brackets are in their forward locations. Changing the elliptical path in this manner changes the level of exercise. That is, a more vertical elliptical path resulting from the double brackets 170 and 172 positioned in their forward locations causes the user to undergo a more strenuous level of exercise than when the double brackets are in their rearward locations. Arrows are shown in FIGS. 6A and 6B to depict the direction the user moves the respective foot pads 154 and 156 to position the single brackets 170 and 172 in their respective forward (FIG. 6A) and rearward (FIG. 6B) locations. Thus, by changing the locations of the single brackets 170 and 172, the user can readily vary the foot motion and thereby adjust the level of exercise on the elliptical exercise machine 200.

Figure 7:
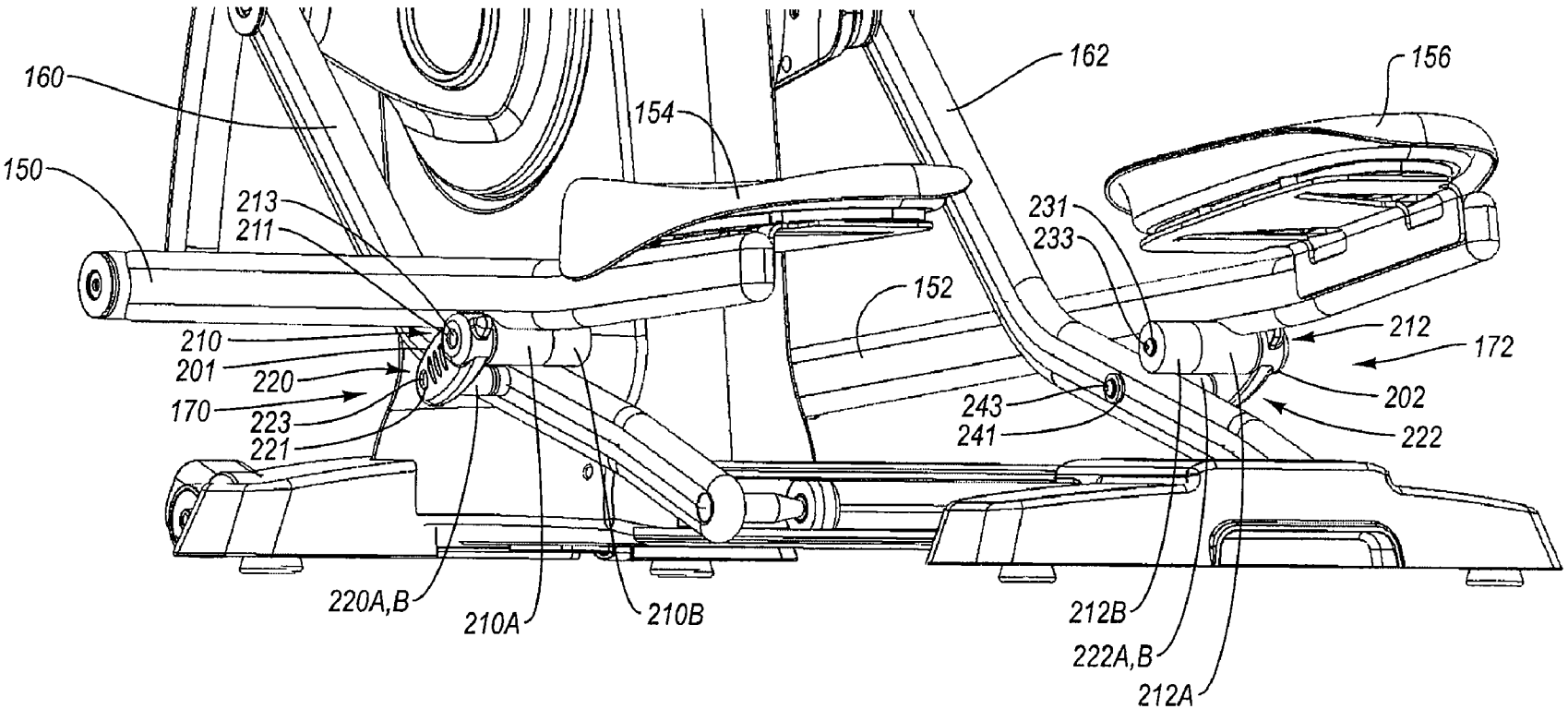
FIG. 7 illustrates an enlarged, cut-away perspective view of the elliptical exercise machine of FIG. 5.

FIG. 7 shows an enlarged, cut-away perspective view of the elliptical exercise machine 200 of FIG. 5. As shown in FIG. 7, the first single bracket 170 pivotally connects the first foot support 150 and the first link arm 160, and comprises a first upper section 210, a first lower section 220, and a first bracket plate 201 joining the two sections (or halves) 210 and 220. The first upper section 210 comprises a first outer tube 210A and a first inner tube 210B that are connected to each other and to the first bracket plate 201 by means of a first upper section axle 211 and a first upper section bolt 213. The first lower section 220 comprises two concentric tubes 220A and 220B that are connected to each other by bushings (not shown and to keep the concentric tubes in place) and to the first bracket plate 201 by means of a first lower section axle 221 and a first upper section bolt 223.

In the exercise machine 200 of FIG. 7, the first outer tube 210A is metal and is welded to the first foot support 150, and the first inner tube 210B is plastic and slides or rides on top of the first link arm 160. Also, in the machine 200 of FIG. 7, all of the tubes 210A, 210B, 220A and 220B have circular cross sections. As noted, the left hand side of exercise machine 200 is identical to the right hand side except that it is offset by 180 degrees. Thus, the second single bracket 172, which pivotally connects the second foot support 152 and the second link arm 162, is identical in both structure and operation to the first single bracket 170, except that it is offset by 180 degrees. Accordingly, FIG. 7 also depicts the second single bracket 172, which comprises a second upper section 212, a second lower section 222, a second bracket plate 202, a second outer tube 212A, a second inner tube 212B, a second upper section axle 231, a second upper section bolt 233, two concentric tubes 220A and 220B, bushings (not shown), a first lower section axle 241, and a first upper section bolt 243.

Figure 8:
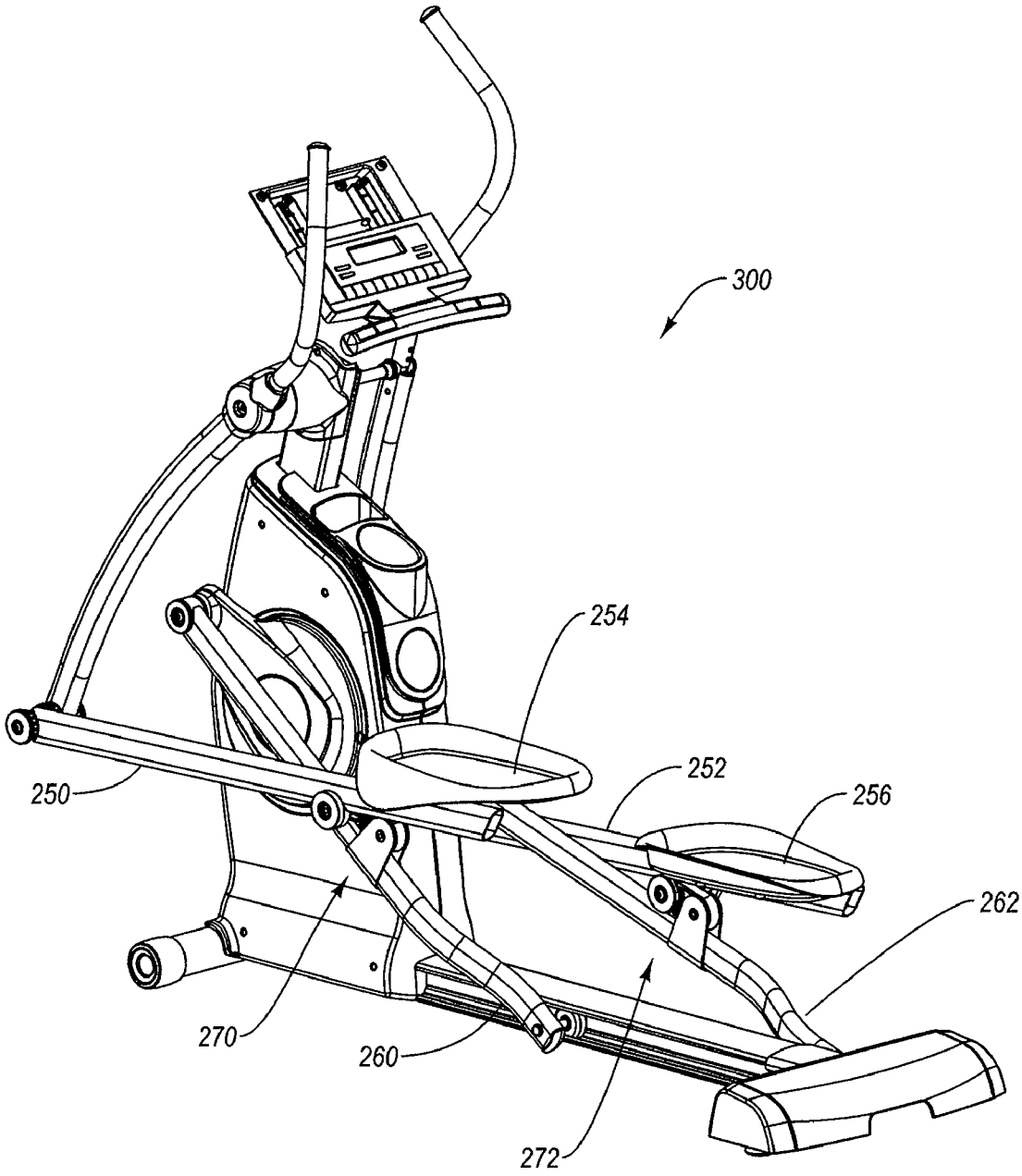
FIG. 8 illustrates a perspective view of an alternative embodiment of a front mechanism elliptical exercise machine according to the present invention.

FIG. 8 shows a perspective view of a front mount or front mechanical-type elliptical exercise machine 300 according to a third exemplary embodiment of the present invention. As shown in FIG. 8, the elliptical exercise machine 300 is similar to the exercise machine 200 except that the foot supports 250 and 252 of machine 300 are pivotally connected to its link arms 260 and 262 by means of respective single brackets 270 and 272, which are distinct from both double brackets 70 and 72 of exercise machine 100 and from the single brackets 170 and 172 of exercise machine 200. To change the locations of the single brackets 270 and 272, the user can merely lift up on a foot pad 254 and 256, and the brackets 270 and 272 will flip to the opposite or different location. Further, as with exercise machines 100 and 200, the left hand side of exercise machine 300 is identical to the right hand side except that it is offset by 180 degrees.

Figure 9A:
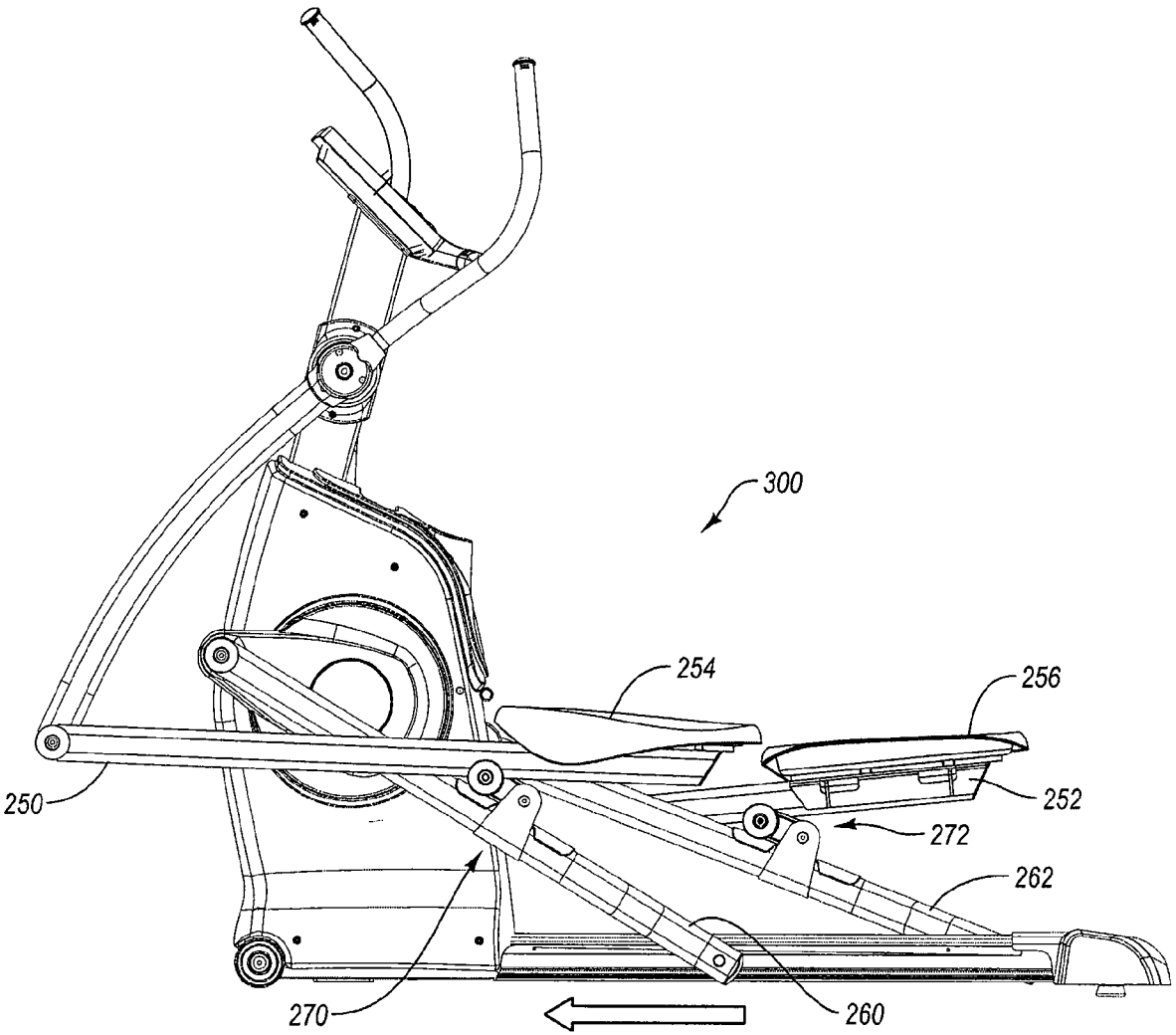
FIG. 9A illustrates a side view of the elliptical exercise machine of FIG. 8.
Figure 9B:
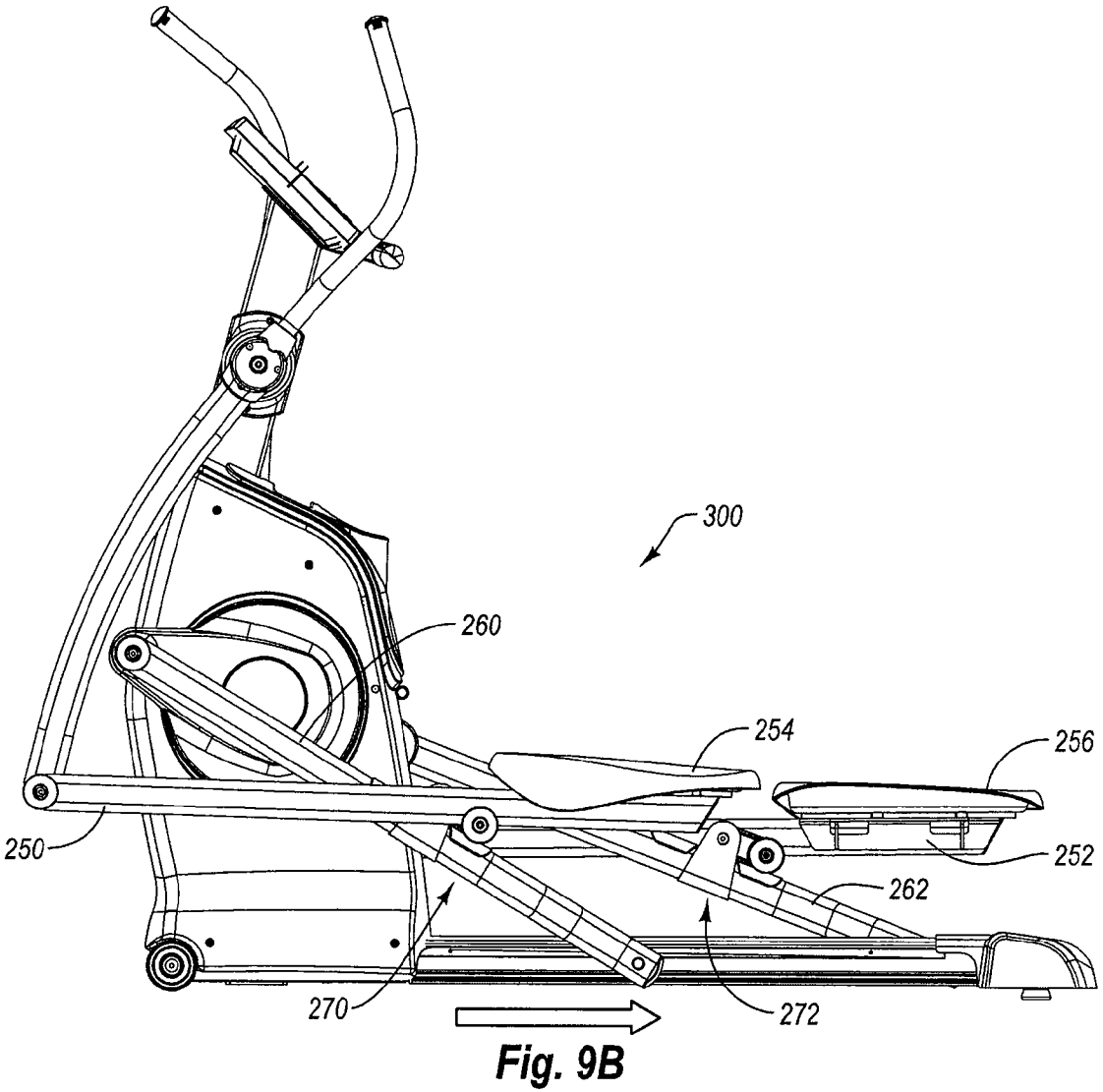
FIG. 9B illustrates another side view of the elliptical exercise machine of FIG. 8.

FIG. 9A shows a side view of the elliptical exercise machine 300 of FIG. 8. As shown in FIG. 9A, the single brackets 270 and 272 are positioned in their respective forward locations. FIG. 9B shows a side view of the elliptical exercise machine 300 of FIG. 8 with the single brackets 270 and 272 positioned in their respective rearward locations. Compared to FIG. 9A, where the single brackets 270 and 272 are in their respective forward locations, the foot pads 254 and 256 of FIG. 9B are in relatively lower and more rearward positions that those of FIG. 9A. In this way, when the single brackets 270 and 272 are positioned in their rearward locations, the elliptical path is less vertical and shorter in length than when the double brackets are in their forward locations. Changing the elliptical path in this manner changes the level of exercise. That is, a more vertical elliptical path resulting from the single brackets 270 and 272 positioned in their forward locations causes the user to undergo a more strenuous level of exercise than when the brackets are in their rearward locations. Arrows are shown in FIGS. 9A and 9B to depict the direction the user moves the respective foot pads 254 and 256 to position the single brackets 270 and 272 in their respective forward (FIG. 9A) and rearward (FIG. 9B) locations. Thus, by changing the locations of the single brackets 270 and 272, the user can readily vary the foot motion and thereby adjust the level of exercise on the elliptical exercise machine 300.

Figure 10:
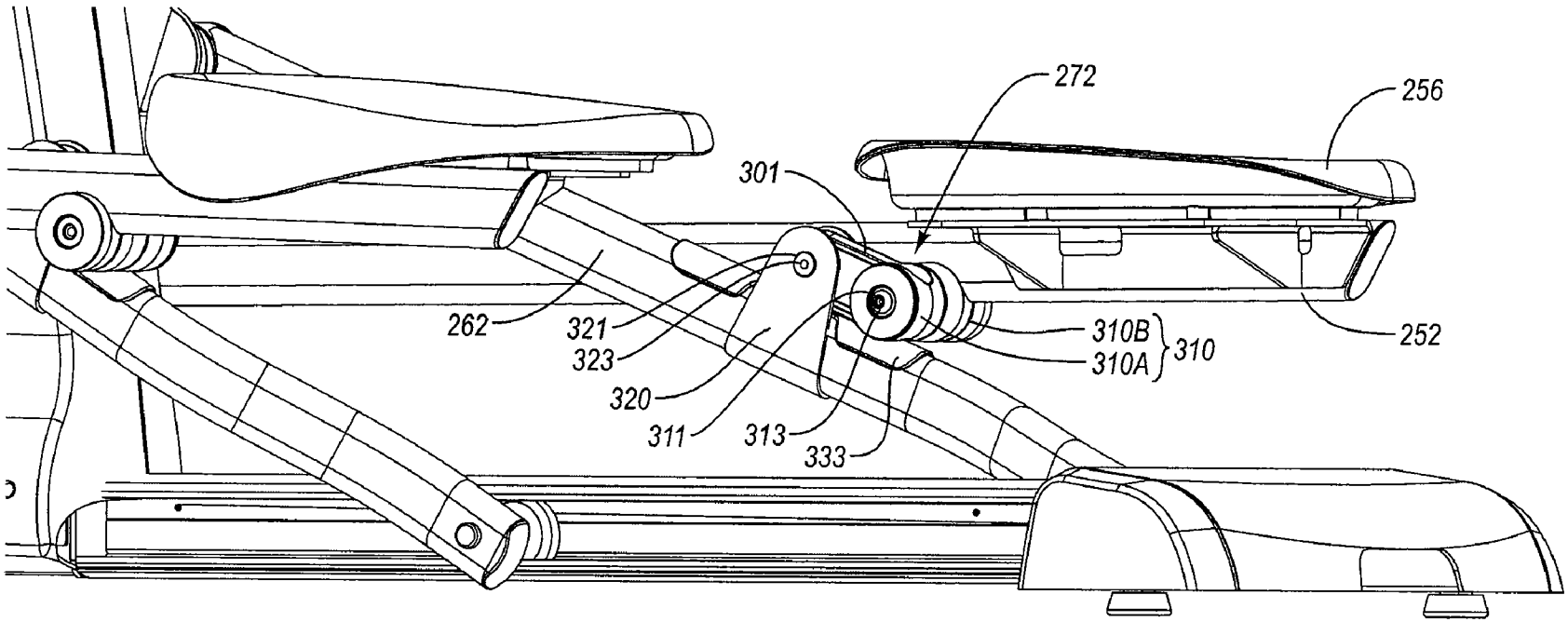
FIG. 10 shows an enlarged, cut-away perspective view of the elliptical exercise machine of FIG. 8.

FIG. 10 shows an enlarged, cut-away perspective view of the elliptical exercise machine 300 of FIG. 8. As shown in FIG. 10, the second single bracket 272 pivotally connects the second foot support 252 and the second link arm 262, and comprises a second movable section 310 (a first half) and a second clamp 320 (a second section/half). A second bracket plate 301 joins the second movable section 310 and the second clamp 320. The second movable section 310 comprises a second outer tube 310A and a second inner tube 310B that are connected to each other and to the second bracket plate 301 by means of a second movable section axle 311 and a second movable section bolt 313. The second clamp 320 is affixed to the second link arm 262 as shown and is connected to the second bracket plate 301 by means of a second clamp axle 321 and a second clamp bolt 323.

In the exercise machine 300 of FIG. 10, the second outer tube 320A is metal and is welded to the second foot support 252, and the second inner tube 320B is plastic and rests on plastic pads 333 on the top surface of the second link arm 262 when the second foot pad 256 is positioned at the desired location. Also, in the machine 300 of FIG. 10, tubes 310A and 310B have circular cross sections. Only second single bracket 272 was described with respect to FIG. 10 merely for illustrative purposes. As noted, the left hand side of exercise machine 300 is identical to the right hand side except that it is offset by 180 degrees. Thus, the first single bracket 270, which pivotally connects the first foot support 250 and the second link arm 260, is identical in both structure and operation to the second single bracket 272, except that it is offset by 180 degrees.

As set forth above, the present invention provides an elliptical exercise machine that allows the user to easily and readily adjust the level of exercise. By changing the locations of the respective brackets of the present invention, e.g., 70, 72 or 170, 172 or 270, 272, the user can readily vary the foot motion and thereby adjust the level of exercise on the respective elliptical exercise machine. That is, a more vertical elliptical path causes the user to undergo a more strenuous level of exercise than when the elliptical path is less vertical, and a more vertical path is achieved when a respective bracket is in its forward position, while a less vertical path is achieved when a respective bracket is in its rearward position.

Although multiple embodiments of the invention are described herein in detail, it will be understood by those skilled in the art that variations may be made thereto without departing from the spirit of the invention or the scope of the claims.

We claim:

1. An elliptical exercise machine with adjustable foot motion comprising:

a frame comprising a base support structure;

a drive assembly situated on the frame;

first and second link arms, each link arm having a first end and a second end, the first end of each link arm being rotatably connected directly to the drive assembly and the second end of each link arm being movably mounted on the base support structure;

first and second reciprocating foot supports, each foot support having a first end and a second end, wherein each foot support moves through an elliptical path;

first and second swing arms, each swing arm having an upper end and a lower end, the upper end of each swing arm being rotatably connected directly to the frame and the lower end of each swing arm being pivotally connected directly to the respective second end of each foot support; and first and second selectively adjustable brackets, wherein the first bracket adjustably connects the first link arm to the first foot support, wherein pivotal movement of the first bracket relative to the first link arm and the first foot support adjusts the position of the first foot support relative to the first link arm, thereby altering the elliptical path of the first foot support, and wherein the second bracket adjustably connects the second link arm to the second foot support, wherein pivotal movement of the second bracket relative to the second link arm and the second foot support adjusts the position of the second foot support relative to the second link arm, thereby altering the elliptical path of the second foot support, wherein the first bracket has a first member and a second member pivotally connected at a first bracket joint rod, wherein the first member of the first bracket is pivotally connected to the first foot support and the second member of the first bracket is pivotally connected to the first link arm, and wherein the second bracket has a first member and a second member pivotally connected at a second bracket joint rod, wherein the first member of the second bracket is pivotally connected to the second foot support and the second member of the second bracket is pivotally connected to the second link arm.

2. The elliptical exercise machine of claim 1, wherein the frame has an upright support structure.

3. The elliptical exercise machine of claim 2, wherein the base support structure has two sides and has a guide rail on each side, and the second end of each link arm has a roller rotatably attached to it such that the second end of each link arm can engage the respective guide rail of the base support structure.

4. The elliptical exercise machine of claim 1, wherein the drive assembly has first and second crank arms and the first end of the first link arm is pivotally connected to the first crank arm and the first end of the second link arm is pivotally connected to the second crank arm.

5. The elliptical exercise machine of claim 1, wherein the first and second brackets are configured to yield different elliptical paths selectable by a user.

6. An elliptical exercise machine with adjustable foot motion comprising:

a frame;

first and second link arms, each link arm having a first end and a second end, the first end of each link arm being rotatably connected to the frame;

first and second reciprocating foot supports, each foot support having a first end and a second end, the first end of each foot support being linked to the frame; and first and second brackets, wherein the first bracket has a first section and a second section, wherein a first end the first section is pivotally connected to a first end of the second section at a first pivot location thereby allowing the first section to move relative to the second section, a second end of the first section of the first bracket being pivotally connected to the first foot support at a second pivot location and a second end of the second section of the first bracket being pivotally connected to the first link arm at a third pivot location, wherein the first bracket movably connects the first link arm to the first foot support and provides a first elliptical path of the first foot support when the first pivot location is closer to the first end of the first link arm than the third pivot location, and wherein the first bracket provides a second elliptical path of the first foot support when the first pivot location is further away from the first end of the first link arm than the third pivot location, and wherein the second bracket has a first section and a second section, wherein a first end the first section of the second bracket is pivotally connected to a first end of the second section of the second bracket at a fourth pivot location thereby allowing the first section of the second bracket to move relative to the second section of the second bracket, a second end of the first section of the second bracket being pivotally connected to the second foot support at a fifth pivot location and a second end of the second section of the second bracket being pivotally connected to the second link arm at a sixth pivot location, wherein the second bracket movably connects the second link arm to the second foot support and provides a first elliptical path of the second foot support when the fourth pivot location is closer to the first end of the second link arm than the sixth pivot location, and wherein the second bracket provides a second elliptical path of the second foot support when the fourth pivot location is further away from the first end of the second link arm than the sixth pivot location.

7. The elliptical exercise machine of claim 6, wherein each bracket has a forward position and a rearward position, wherein each position yields a different elliptical path for each foot support and thereby a different foot motion for a user.

8. The elliptical exercise machine of claim 7, wherein the user can move each bracket between the forward position and the rearward position.

9. The elliptical exercise machine of claim 8 further comprising:

first and second knobs, each knob being connected to a respective bracket and situated such that the user can grasp the knob and move the bracket between the forward position and the rearward position.

10. The elliptical exercise machine of claim 6 further comprising:

first and second swing arms, each swing arm having an upper end and a lower end, the upper end of each swing arm being rotatably connected to the frame and the lower end of each swing arm being pivotally connected to the respective first end of each foot support.

11. The elliptical exercise machine of claim 6, wherein the frame has a base support structure and an upright support structure.

12. The elliptical exercise machine of claim 11, wherein the base support structure has two sides and has a guide rail on each side, and the second end of each link arm has a roller rotatably attached to it such that the second end of each link arm can engage the respective guide rail of the base support structure.

13. The elliptical exercise machine of claim 6 further comprising a drive assembly situated on the frame, wherein the drive assembly has first and second crank arms and the first end of the first link arm is pivotally connected to the first crank arm and the first end of the second link arm is pivotally connected to the second crank arm.

14. An elliptical exercise machine with adjustable foot motion comprising:

a frame having a base support structure and an upright support structure;

a drive assembly situated on the frame;

first and second link arms, each link arm having a first end and a second end, the first end of each link arm being rotatably connected to the drive assembly, and the second end of each link arm being movably connected to the base support structure;

first and second reciprocating foot supports, each foot support having a first end adapted to support a foot of a user thereon during exercise and a second end, each foot support being adapted to move through an elliptical path;

first and second swing arms, each swing arm having an upper end and a lower end, the upper end of each swing arm being rotatably connected to the frame and the lower end of each swing arm being pivotally connected to the respective second end of each foot support; and first and second brackets, wherein the first bracket has a first section pivotally connected to a second section, the first section of the first bracket being pivotally connected to the first foot support between the first and second ends of the first foot support and the second section of the first bracket being pivotally connected to the first link arm, wherein the first bracket movably connects the first link arm to the first foot support, and wherein the second bracket has a first section and a second section, the first section of the second bracket being pivotally connected to the second foot support between the first and second ends of the second foot support and the second section of the second bracket being pivotally connected to the second link arm, wherein the second bracket movably connects the second link arm to the second foot support, wherein the first bracket and second brackets are adapted to selectively alter the elliptical path of each of the foot supports.

15. The elliptical exercise machine of claim 14, wherein each bracket has a forward position and a rearward position, wherein each position yields a different elliptical path for each foot support and thereby a different foot motion for a user, and wherein the first bracket is in (i) the first configuration when in the forward position and (ii) the second configuration when in the rearward position, and wherein the second bracket is in (i) the third configuration when in the forward position and (ii) the fourth configuration when in the rearward position.

16. The elliptical exercise machine of claim 15, wherein the user can move each bracket between the forward position and the rearward position.

17. The elliptical exercise machine of claim 16 further comprising:

first and second knobs, each knob being connected to a respective bracket and situated such that the user can grasp the knob and move the bracket between the forward position and the rearward position.

18. The elliptical exercise machine of claim 14, wherein the first bracket is adapted to selectively adjust the position of the first foot support relative to the first link arm to alter the elliptical path of the first foot support, and wherein the second bracket is adapted to selectively adjust the position of the second foot support relative to the second link arm to alter the elliptical path of the second foot support.

19. The elliptical exercise machine of claim 14, wherein the base support structure has two sides and has a guide rail on each side, and the second end of each link arm has a roller rotatably attached to it such that the second end of each link arm can engage the respective guide rail of the base support structure.

20. The elliptical exercise machine of claim 14, wherein the drive assembly has first and second crank arms and the first end of the first link arm is pivotally connected to the first crank arm and the first end of the second link arm is pivotally connected to the second crank arm.

21. An elliptical exercise machine with adjustable foot motion comprising:

a frame;

first and second link arms, each link arm having a first end and a second end, the first end of each link arm being rotatably connected to the frame;

first and second reciprocating foot supports, each foot support having a first end and a second end, the first end of each foot support being linked to the frame;

first and second brackets, wherein the first bracket pivotally connects the first link arm with the first foot support, and wherein the second bracket pivotally connects the second link arm with the second foot support, wherein each bracket is adjustable between a forward position and a rearward position relative to its respective link arm while maintaining pivotal securement to a respective foot support and link arm, wherein each bracket can be selectively moved relative to its respective link arm, and wherein each position yields a different elliptical path for each foot support and thereby a different foot motion for a user; and wherein, when the exercise machine is positioned on a support surface for use by a user, the connection between the first bracket and the first foot support is above the connection between the first bracket and the first link arm, and the connection between the second bracket and the second foot support is above the connection between the second bracket and the second link arm.

22. The elliptical exercise machine of claim 21, wherein the user can move each bracket between the forward position and the rearward position.

23. The elliptical exercise machine of claim 22 further comprising:

first and second knobs, each knob being connected to a respective bracket and situated such that the user can grasp the knob and move the bracket between the forward position and the rearward position.

24. The elliptical exercise machine of claim 21 further comprising:

first and second swing arms, each swing arm having an upper end and a lower end, the upper end of each swing arm being rotatably connected to the frame and the lower end of each swing arm being pivotally connected to the respective first end of each foot support.

25. The elliptical exercise machine of claim 21, wherein the frame has a base support structure and an upright support structure.

26. The elliptical exercise machine of claim 25, wherein the base support structure has two sides and has a guide rail on each side, and the second end of each link arm has a roller rotatably attached to it such that the second end of each link arm can engage the respective guide rail of the base support structure.

27. The elliptical exercise machine of claim 21 further comprising a drive assembly situated on the frame, wherein the drive assembly has first and second crank arms and the first end of the first link arm is pivotally connected to the first crank arm and the first end of the second link arm is pivotally connected to the second crank arm.

28. The elliptical exercise machine of claim 21, wherein the first bracket has a first member and a second member pivotally connected at a first bracket joint rod, wherein the first member of the first bracket is pivotally connected to the first foot support and the second member of the first bracket is pivotally connected to the first link arm, and wherein the second bracket has a first member and a second member pivotally connected at a second bracket joint rod, wherein the first member of the second bracket is pivotally connected to the second foot support and the second member of the second bracket is pivotally connected to the second link arm.

29. The elliptical exercise machine of claim 22 further comprising:

first and second springs, each spring being connected to a respective bracket and situated such that the springs will facilitate movement of each bracket between the forward position and the rearward position.

30. The elliptical exercise machine of claim 21, wherein:

the first bracket comprises a first movable section and a first clamp pivotally linked together by a first bracket plate; and the second bracket comprises a second movable section and a second clamp pivotally linked together by a second bracket plate.

31. An elliptical exercise machine with adjustable foot motion comprising:

a frame;

a drive assembly situated on the frame;

first and second link arms, each link arm having a first end and a second end, the first end of each link arm being rotatably connected to the drive assembly;

first and second reciprocating foot supports, each foot support having a first end and a second end, the first end of each foot support being pivotally interconnected to the frame;

first and second brackets, wherein the first bracket adjustably connects the first link arm to the first foot support, and wherein the second bracket adjustably connects the second link arm to the second foot support;

wherein a user can selectively alter an elliptical path of the first reciprocating foot support by lifting the first foot support thereby causing the first bracket to pivot relative to the frame between a first configuration and at least a second configuration; and wherein a user can selectively alter an elliptical path of the second reciprocating foot support by lifting the second foot support thereby causing the second bracket to pivot relative to the frame between a third configuration and at least a fourth configuration.

32. An elliptical exercise machine with adjustable foot motion comprising:

a frame comprising a base support structure;

a drive assembly situated on the frame;

first and second link arms, each link arm having a first end and a second end, the first end of each link arm being rotatably connected directly to the drive assembly and the second end of each link arm being movably mounted on the base support structure;

first and second reciprocating foot supports, each foot support having a first end and a second end, wherein each foot support moves through an elliptical path;

first and second swing arms, each swing arm having an upper end and a lower end, the upper end of each swing arm being rotatably connected directly to the frame and the lower end of each swing arm being pivotally connected directly to the respective second end of each foot support;

first and second selectively adjustable brackets, wherein the first bracket adjustably connects the first link arm to the first foot support, wherein pivotal movement of the first bracket relative to the first link arm and the first foot support adjusts the position of the first foot support relative to the first link arm, thereby altering the elliptical path of the first foot support, and wherein the second bracket adjustably connects the second link arm to the second foot support, wherein pivotal movement of the second bracket relative to the second link arm and the second foot support adjusts the position of the second foot support relative to the second link arm, thereby altering the elliptical path of the second foot support, wherein each bracket has a forward position and a rearward position, wherein each position of the first bracket yields a different elliptical path for the first foot support and each position of the second bracket yields a different elliptical path for the second foot support and thereby a different foot motion for a user, wherein the user can move each bracket between the forward position and the rearward position; and first and second knobs, each knob being connected to a respective bracket and situated such that the user can grasp the knob and move the respective bracket between the forward position and the rearward position to alter the elliptical path of the respective foot support.

* * * * *

UNITED STATES PATENT AND TRADEMARK OFFICE

CERTIFICATE OF CORRECTION

PATENT NO. : 7,674,205 B2
APPLICATION NO. : 11/745708
DATED : March 9, 2010
INVENTOR(S) : Dalebout et al.

It is certified that error appears in the above-identified patent and that said Letters Patent is hereby corrected as shown below:

Column 2
Line 2, after "by", remove [either]
Lines 16, 18, and 19, change all three instances of "the each bracket" to --each bracket--

Column 3
Line 15, after "skilled in the art", insert --to--

Column 4
Line 30, after "bracket", remove [and]
Line 61, change "Figures," to --figures,--

Column 5
Line 29, change "that" to --than--

Column 6
Line 3, change "that" to --than--
Lines 6, 9, 11, change all three instances of "double brackets" to --single brackets--
Line 53, change "220A and 220B" to --222A and 222B--

Column 7
Line 13, change "that" to --than--
Line 16, change "double brackets" to --single brackets--
Line 45, change "320A" to --310A--
Line 46, change "320B" to --310B--
Line 56, change "link arm 260," to --link arm 262,--

Column 9
Line 11, change "first end the" to --first end of the--
Line 29, change "end the first section" to --end of the first section--

Signed and Sealed this

Fourteenth Day of December, 2010

David J. Kappos

David J. Kappos
*Director of the United States Patent and Trademark Office*

Column 10
Line 55, after “first”, remove [bracket]